US008934798B2

(12) United States Patent
Hayakawa

(10) Patent No.: US 8,934,798 B2
(45) Date of Patent: Jan. 13, 2015

(54) IMAGE FORMING APPARATUS

(71) Applicant: Canon Kabushiki Kaisha, Tokyo (JP)

(72) Inventor: Masahiro Hayakawa, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/021,851

(22) Filed: Sep. 9, 2013

(65) Prior Publication Data

US 2014/0072318 A1 Mar. 13, 2014

(30) Foreign Application Priority Data

Sep. 11, 2012 (JP) ..... 2012-199517

(51) Int. Cl.
*G03G 15/043* (2006.01)
*G03G 15/047* (2006.01)

(52) U.S. Cl.
CPC ..... *G03G 15/043* (2013.01); *G03G 15/047* (2013.01); *G03G 2215/0132* (2013.01)
USPC ..... 399/51

(58) Field of Classification Search
USPC ..... 399/38, 50–56
See application file for complete search history.

(56) References Cited

U.S. PATENT DOCUMENTS

| | | | | |
|---|---|---|---|---|
| 7,171,134 | B2 | 1/2007 | Denton et al. | |
| 7,457,554 | B2 * | 11/2008 | Matsuda et al. | 399/50 |
| 2012/0147119 | A1 | 6/2012 | Toyoizumi et al. | |
| 2012/0230705 | A1 | 9/2012 | Shimura et al. | |

FOREIGN PATENT DOCUMENTS

| | | | |
|---|---|---|---|
| JP | H08-171260 | A | 7/1996 |
| JP | H11-102145 | A | 4/1999 |
| JP | 2002-296853 | A | 10/2002 |
| JP | 2003-312050 | A | 11/2003 |
| JP | 2004-85976 | A | 3/2004 |

* cited by examiner

*Primary Examiner* — Hoan Tran
(74) *Attorney, Agent, or Firm* — Canon USA Inc IP Division

(57) ABSTRACT

An image forming apparatus includes an exposure unit configured to form a latent image by irradiating a charged photosensitive member with light, and a control unit configured to cause the exposure unit to expose an image portion to which toner of the photosensitive member is to be adhered by a first exposure amount, and expose a non-image portion to which the toner of the photosensitive member is not to be adhered by a second exposure amount which is smaller than the first exposure amount. The control unit corrects the preset second exposure amount based on information about a difference between the charging voltage output from the charging unit and a predetermined charging voltage and/or information about a difference between the developing voltage output from the developing unit and a predetermined developing voltage.

8 Claims, 19 Drawing Sheets

FIG. 11

| CONTRAST CORRECTION VOLTAGE V2 | NORMAL CORRECTION EXPOSURE AMOUNT ΔE | MICRO CORRECTION EXPOSURE AMOUNT Δebg |
|---|---|---|
| ∓1V | E×(±1%) | Ebg×(±1%) |
| ∓2V | E×(±2%) | Ebg×(±2%) |
| ∓3V | E×(±3%) | Ebg×(±3%) |
| ∓4V | E×(±4%) | Ebg×(±4%) |
| ∓5V | E×(±5%) | Ebg×(±5%) |
| ∓6V | E×(±6%) | Ebg×(±6%) |
| ∓7V | E×(±7%) | Ebg×(±7%) |
| ∓8V | E×(±8%) | Ebg×(±8%) |
| ∓9V | E×(±9%) | Ebg×(±9%) |
| ∓10V | E×(±10%) | Ebg×(±10%) |

IMAGE FORMING APPARATUS

BACKGROUND OF THE INVENTION

1. Field of the Invention

The present disclosure relates to an image forming apparatus such as a laser printer, a copying machine, or a facsimile machine that uses an electrophotographic recording method.

2. Description of the Related Art

There has conventionally been known an image forming apparatus such as a copying machine or a laser printer that uses the electrophotographic recording method. In such an image forming apparatus, reduction in cost and size of the apparatus are required. Under these circumstances, Japanese Patent Application Laid-Open No. 11-102145 discusses, for the purpose of reduction in size of an apparatus, a monochrome printer that applies a voltage to a developing unit and a charging unit from one common high-voltage power source.

In recent years, a color image forming apparatus has been widely known and used by users. In the color image forming apparatus, a plurality of image forming stations including photosensitive drums is disposed corresponding to a plurality of colors, and the structure thereof is complex, causing enlargement of the apparatus. Thus, the reduction in size of the apparatus is particularly important in the color image forming apparatus.

Concerning the common use of the high-voltage power source, for example, when power sources of a plurality of charging units are replaced by one common power source, the following problems may occur. As the color image forming apparatus, there is known a color image forming apparatus of a tandem type where photosensitive drums of respective colors are independently arranged. In this color image forming apparatus of the tandem type, photosensitive characteristics (EV characteristics) of the respective photosensitive drums may change due to various factors. In this case, if a circuit configuration where a common power source is used for the charging unit of each color, and independent power supply control of charging voltages at the respective photosensitive drums cannot be performed is employed, a charging potential cannot be appropriately set for each photosensitive drum. In such a case, for example, when control of developing potential is insufficient, a relationship between the charging potential and the developing potential is worsened, causing easy generation of image failures such as fogging where toner is transferred to a non-image portion.

Relating to the aforementioned problems, even if no common high-voltage power source is used, when the power supply control capability (voltage conversion capability) of each high-voltage power source is insufficient, or when no independent power supply control is performed, the similar problem of image failures may occur.

SUMMARY OF THE INVENTION

In view of the aforementioned problems, an embodiment of the present invention is directed to an image forming apparatus capable of suppressing image failures by appropriately setting a charging voltage and a developing potential.

An embodiment of the present invention is also directed to an image forming apparatus described below.

According to an aspect of the present invention, an image forming apparatus includes a photosensitive member, a charging unit configured to charge the photosensitive member by outputting a charging voltage, an exposure unit configured to form a latent image on the photosensitive member by irradiating the charged photosensitive member with light, a developing unit configured to develop the latent image on the photosensitive member with toner by outputting a developing voltage, and a control unit configured to cause the exposure unit to expose an image portion to which the toner of the photosensitive member is to be adhered by a first exposure amount, and expose a non-image portion to which the toner of the photosensitive member is not to be adhered by a second exposure amount smaller than the first exposure amount, wherein the control unit corrects the preset second exposure amount based on information about a difference between the charging voltage output from the charging unit and a predetermined charging voltage and/or information about a difference between the developing voltage output from the developing unit and a predetermined developing voltage.

Further features of the present invention will become apparent from the following detailed description of exemplary embodiments with reference to the attached drawings.

BRIEF DESCRIPTION OF THE DRAWINGS

FIG. 11 is a table illustrating correspondence between a contrast correction voltage and a normal exposure correction amount, and a microexposure correction amount.

DESCRIPTION OF THE EMBODIMENTS

Various exemplary embodiments, features, and aspects of the invention will be described in detail below with reference to the drawings. Components described in the embodiments are only examples, and are not intended to limit the scope of the present invention.

First, referring to FIGS. 1 to 5B, a configuration of a color image forming apparatus (hereinbelow, referred to as image forming apparatus) will be described. Then, referring to FIGS. 6 to 9B, a control operation relating to microexposure will be described. Lastly, referring to FIG. 10, effects relating to a fogging amount and image uniformity will be described.

<Schematic Diagram of Cross Section of Image Forming Apparatus>

Figure 1:
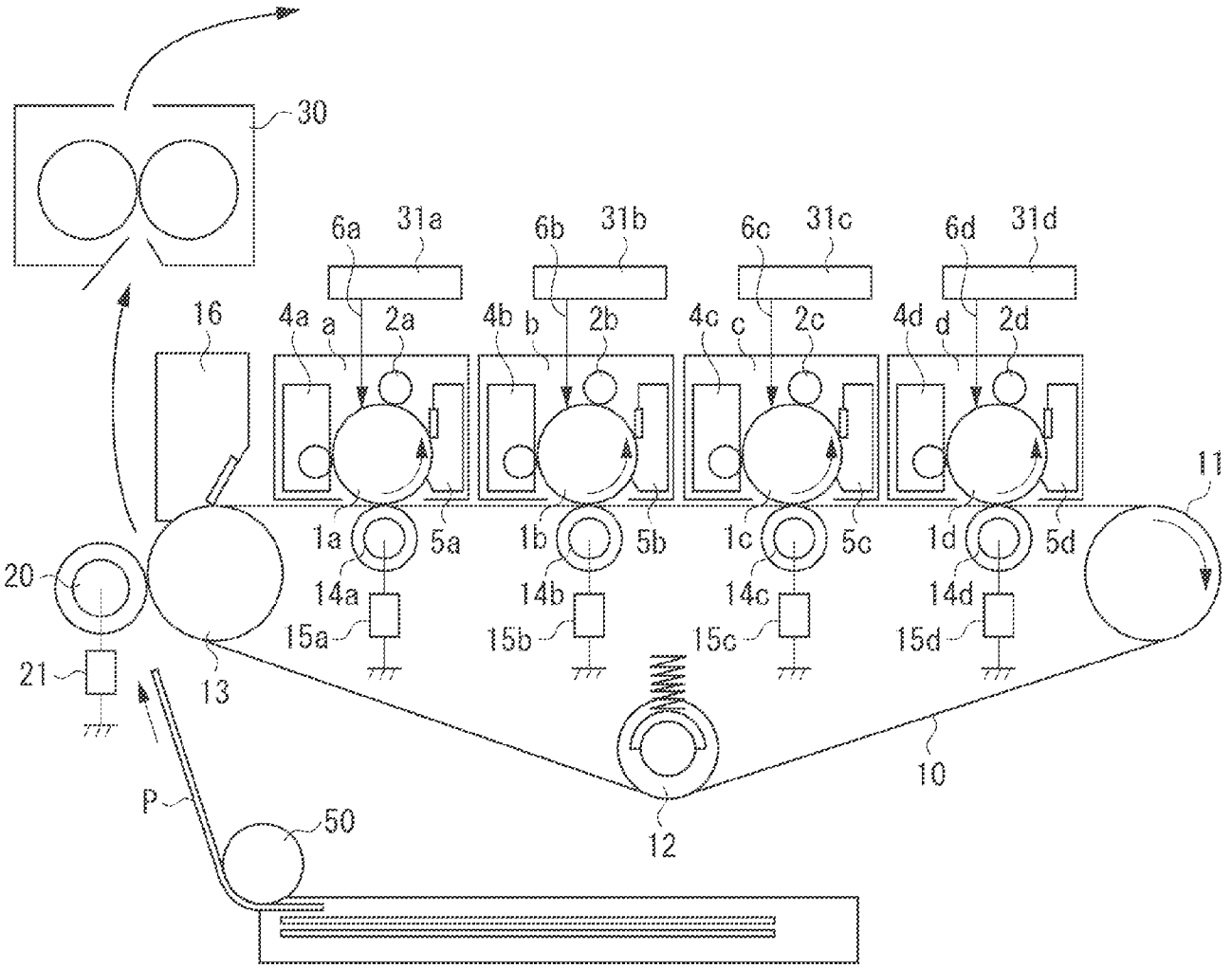
FIG. 1 is a diagram schematically illustrating a cross section of an image forming apparatus.

FIG. 1 is a diagram schematically illustrating a cross section of an image forming apparatus. Referring to FIG. 1, a configuration and an operation of the image forming apparatus according to the present exemplary embodiment will be described. The image forming apparatus includes first to fourth image forming stations (image forming station a to image forming station d): the first image forming station a is for yellow (hereinbelow, referred to Y), the second image forming station b is for magenta (hereinbelow, referred to M), the third image forming station c is for cyan (hereinbelow, referred to C), and the fourth image forming station d is for black (hereinbelow, referred to Bk). The stations a to d respectively include storage members (memory tags) for storing the integrated numbers of rotations of photosensitive drums 1*a* to 1*d* as information about lives of the photosensitive drums. Each station is replaceable with respect to an image forming apparatus body. Each station is only required to include at least a photosensitive drum. There are no restrictions on up to which member is included in the image forming station to be replaceable.

Hereinbelow, an example of an operation of the first image forming station (Y) a as a representative of the stations will be described. The image forming station includes the photosensitive drum 1*a* as a photosensitive member. The photosensitive drum 1*a* is driven to rotate in an arrow direction at a predetermined circumferential speed (process speed). The photosensitive drum 1*a* is uniformly charged to a charging potential of a predetermined polarity by a charging roller 2*a*. Then, by scanning with a laser beam 6*a* of an exposure unit 31*a* based on image data (image signal) supplied from the outside, a surface of the photosensitive drum 1*a* corresponding to an image portion is exposed to remove charges, thereby forming an exposure potential Vl on the surface of the photosensitive drum 1*a*. Then, at the exposure potential Vl portion that is the image portion, the image portion is developed with toner to be visible based on a potential difference between a developing voltage Vdc and the exposure potential Vl applied to a first developing unit (yellow developing device) 4*a*. The image forming apparatus of the present exemplary embodiment is an image forming apparatus of a reversal development type that performs image exposure by the exposure unit 31*a* to perform toner develop on an exposure portion.

An intermediate transfer belt 10 is stretched by stretching members 11, 12, and 13 to abut against the photosensitive drum 1*a*. The intermediate transfer belt 10 is driven to rotate at the abutment position in the same direction and at roughly the same circumferential speed as those of the photosensitive drum 1*a*. A yellow toner image formed on the photosensitive drum 1*a* is, during its passage through an abutment portion (hereinbelow, primary transfer nip) between the photosensitive drum 1*a* and the intermediate transfer belt 10, transferred onto the intermediate transfer belt 10 by a primary transfer voltage applied to a primary transfer roller 14*a* from a primary transfer power source 15*a* (primary transfer). Primary transfer residual toner left on the surface of the photosensitive drum 1*a* is cleaned and removed by a cleaning unit 5*a*, and then the image forming processing of charging processing and thereafter is repeated.

Thereafter, in a similar manner, a magenta toner image (M) of a second color, a cyan toner image (C) of a third color, and a black toner image (Bk) of a fourth color are formed, and sequentially transferred and stacked onto the intermediate transfer belt 10, thereby forming a combined color image.

The toner images of the four colors on the intermediate transfer belt 10 are, during the passage through an abutment portion (hereinbelow, secondary transfer nip) between the intermediate transfer belt 10 and a secondary transfer roller 20, collectively transferred onto a surface of a recording material P fed by a sheet feeding unit 50 by a secondary transfer voltage applied to the secondary transfer roller 20 from a secondary transfer power source 21. Then, the recording material P bearing the toner image of the four colors is introduced to a fixing device 30. The toner of the four colors is heated and pressurized at the fixing device 30 to be mixed, and then fixed on the recording material P. With this operation, a full-color toner image is formed on a recording medium. Secondary transfer residual toner left on the surface of the intermediate transfer belt 10 is cleaned and removed by an intermediate transfer belt cleaning unit 16.

Referring to FIG. 1, the example of the image forming apparatus including the intermediate transfer belt 10 has been described. However, the present exemplary embodiment is not limited to this. For example, the present exemplary embodiment can be realized by an image forming apparatus that includes a recording material conveyance belt (on recording material bearing member) and employs a method for directly transferring a toner image developed on a photosensitive drum to a recording material conveyed on the recording material conveyance belt. Hereinbelow, the example of the image forming apparatus including the intermediate transfer belt 10 will be described.

<Cross Section of Photosensitive Drum>

Figure 2:
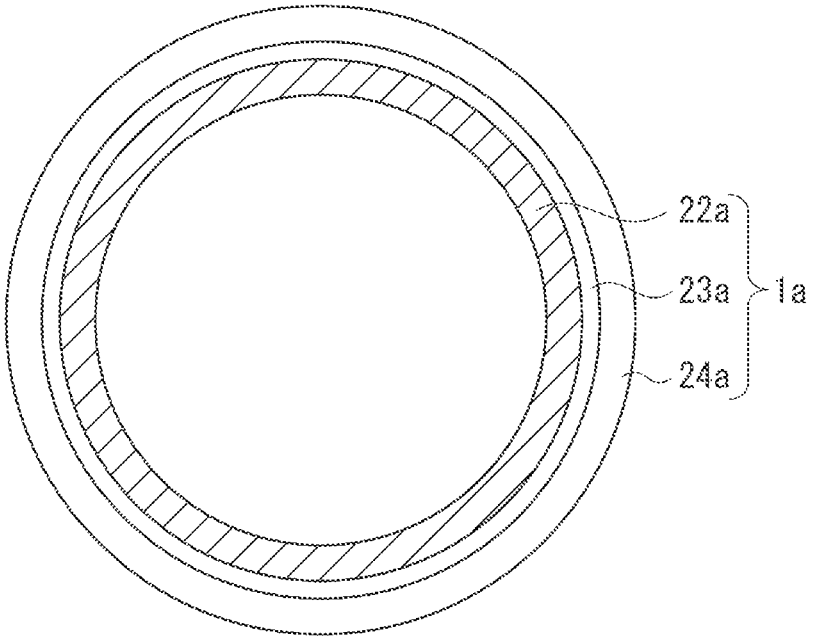
FIG. 2 is a diagram illustrating a cross section of a photosensitive drum.

FIG. 2 illustrates an example of a cross section of the photosensitive drum 1*a*. The photosensitive drum 1*a* includes a charge generation layer 23*a* and a charge transport layer 24*a* stacked on a conductive support substrate 22*a*. The conductive support substrate 22*a* is, for example, an aluminum cylinder having an outer diameter of 30 mm and a thickness of 1 mm. The charge generation layer 23*a* is, for example, a phthalocyanine pigment having a thickness of 0.2 μm. The charge transport layer 24*a* has, for example, a thickness of 20 μm and uses polycarbonate as a binding resin, an amine compound as a charge transport material is mixed therein as a charge transport material. Needless to say, FIG. 2 illustrates one example of the photosensitive drum 1*a*, and sizes and materials are not limited to those described above.

<Sensitivity Characteristics of Photosensitive Drum>

Figure 3:
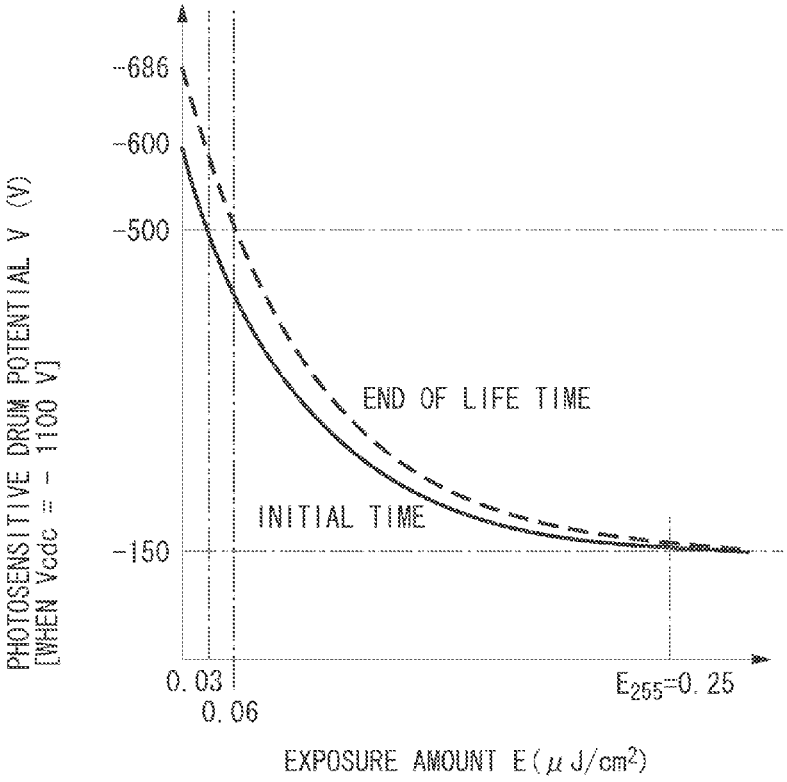
FIG. 3 is a graph illustrating an example of sensitive characteristics (EV curve) of the photosensitive drum.

FIG. 3 illustrates an example of an EV curve indicating sensitivity characteristics of the photosensitive drum, specifically potential attenuation when exposure is performed with a laser beam, so that an exposure amount on the surface of the photosensitive drum can be E ($\mu J/cm^2$) with respect to the photosensitive drum having its surface charged to V. The EV curve indicates that large potential attenuation is obtained by increasing the exposure amount E. At a high potential portion, an environment is an intense electric field, and recoupling of charge carriers (electron-hole pair) generated by exposure is difficult to occur. Thus, potential attenuation is large even when an exposure amount is small. On the other hand, at a low potential portion, a phenomenon of small potential attenuation is generated with respect to exposure of a large exposure amount because recoupling of generated carriers is easy to occur. FIG. 3 separately illustrates an EV curve at an early stage of using the photosensitive drum, and an EV curve when the photosensitive drum has been continuously used and is about to reach its life. In FIG. 3, a curve indicated by a broken line is an EV curve when the photosensitive drum is about to reach its life. The sensitivity characteristics of the photosensitive drum illustrated in FIG. 3 are only an example. In the present exemplary embodiment, a photosensitive drum having various EV curves may be applied.

<Diagram of Image Forming System>

Figure 4:
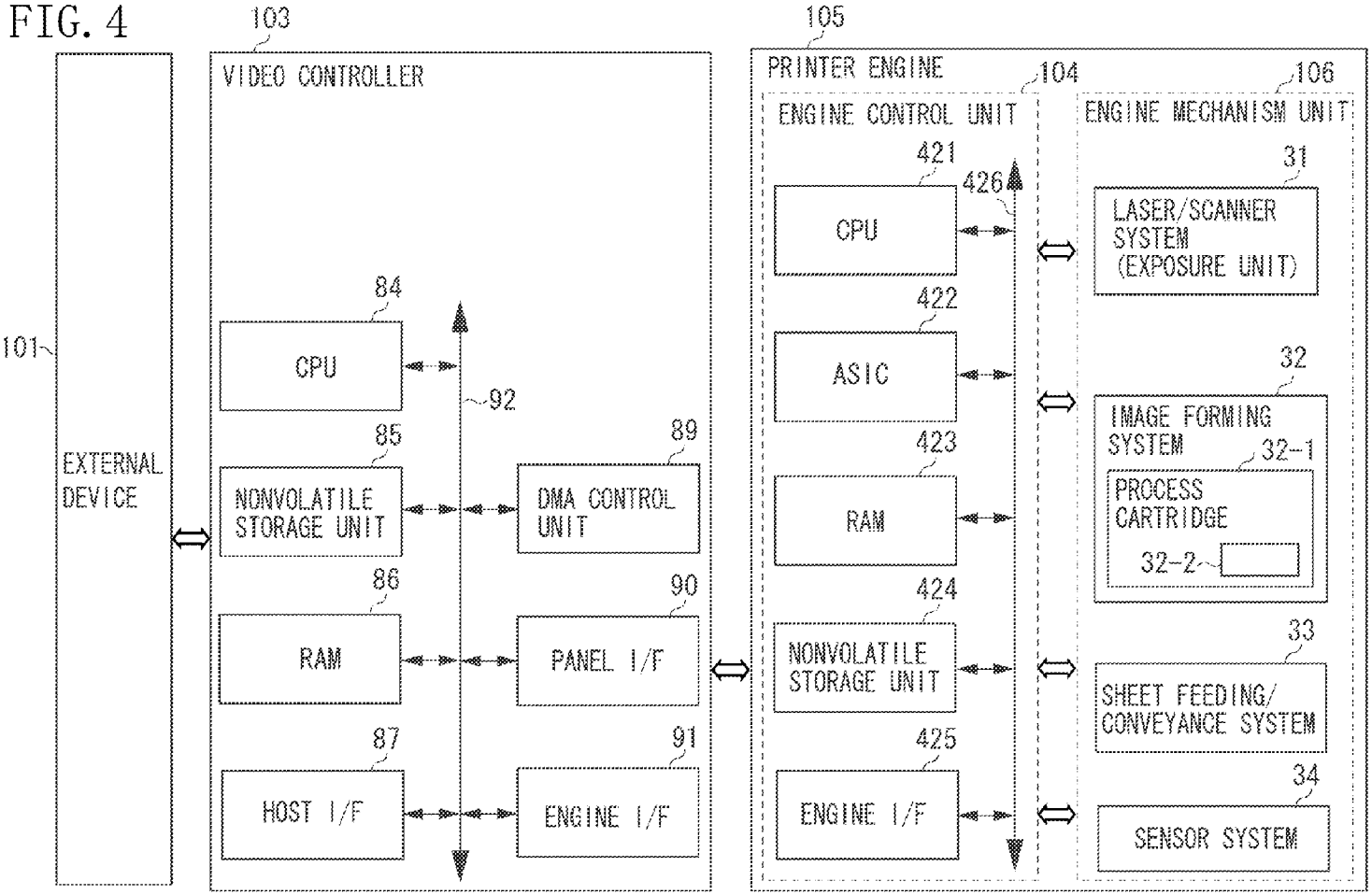
FIG. 4 is a block diagram illustrating an image forming system.

FIG. 4 is a block diagram illustrating an image forming system that includes an external device 101, a video controller 103, and a printer engine 105. The printer engine 105 includes an engine control unit 104 and an engine mechanical unit 106. Hereinbelow, each unit will be described.

<Video Controller>

First, the video controller 103 will be described. A central processing unit 84 is responsible for overall control of the video controller. A nonvolatile storage unit 85 stores various control codes executed by the CPU 84. The nonvolatile storage unit 85 corresponds to a read-only memory (ROM), an electrically erasable programmable ROM (EEPROM), or a hard disk. A random access memory (RAM) 86, which functions as a main memory or a work area for the CPU 84, is a storage unit for temporary storage. A host interface 87 is an input/output unit for print data and control data with the external device 101 such as a host computer. The print data received by the host interface 87 is stored in the RAM 86. A direct memory access (DMA) control unit 89 transfers the image data in the RAM 86 to an engine interface 91 according to an instruction from the CPU 84. A panel interface 90 receives various settings or instructions from an operator through a panel unit provided in a printer body. The engine interface 91 that is a signal input/output unit with the printer engine 105 transmits a data signal from an output buffer register (not illustrated), and performs communication control with the printer engine 105. A system bus 92 includes an address bus and a data bus. The components are connected to the system bus 92 to be accessible to one another.

<Printer Engine>

Next, the printer engine 105 will be described. The printer engine 105 is roughly divided into an engine control unit 104 and an engine mechanism unit 106. The engine mechanism unit 106 is a unit operated by various instructions from the engine control unit 104, and a generic term of a mechanism relating to the image formation described above referring to FIG. 1.

A laser/scanner system 31 functions as an exposure unit, and includes a laser emission element, a laser driver circuit, a scanner motor, a rotary polygon mirror, and a scanner driver. This is a unit for forming a latent image on the photosensitive drum by subjecting the photosensitive drum to exposure scanning with a laser beam according to the image data transmitted from the video controller 103.

An image forming system 32, which is a central portion of the engine mechanism unit, is a unit for forming a toner image based on the latent image formed on the photosensitive drum on a recording medium. The image forming system 32 includes process elements such as a process cartridge, an intermediate transfer belt, and a fixing device constituting an image forming station, and a high-voltage power source circuit for generating various biases (high voltage) for image formation.

The process cartridge 32-1 includes at least a photosensitive drum, and further includes a static eliminator, a charging roller, and a developing roller. The process cartridge 32-1 constitutes at least a part of the image forming station. The process cartridge 32-1 includes a nonvolatile memory tag 32-2, and a CPU 421 or an application specific integrated circuit (ASIC) 422 in the engine control unit 104 stores or reads various pieces of information in the memory tag.

A sheet feeding/conveyance system, which is responsible for feeding/conveying the recording medium, includes various conveyance system motors, a sheet feeding/discharging tray, and various conveyance rollers. A sensor system is a sensor group for collecting information necessary when the CPU 421 or the ASIC 422 described below controls the laser/scanner system, the image forming system, or the sheet feeding/conveyance system. The sensor group includes at least various known sensors such as a temperature sensor of the fixing device, a toner residual amount detection sensor, a density sensor for detecting a density of an image, a sheet size sensor, a sheet leading edge detection sensor, and a sheet conveyance detection sensor. Information detected by various sensors is transmitted to a CPU 421, and reflected on various operations of the image forming system and process sequence control. The sensor system has been described to be included in the laser/scanner system, the image forming system, and the sheet feeding/conveyance system, but may be included in any one of the mechanisms.

Next, the engine control unit 104 will be described. The CPU 421 uses the RAM 423 as a main memory or a work memory, and controls the engine mechanism unit 104 according to various control programs stored in the nonvolatile storage unit 424. More specifically, the CPU 421 drives the laser/scanner system based on a print control command and the image data input from the video controller 103 via the engine I/F 91 and the engine I/F 425. The CPU 421 controls various print sequences by controlling the image forming system 32 and the sheet feeding/conveyance system 33. The CPU 421 obtains information necessary for controlling the image forming system and the sheet feeding/conveyance system by driving the sensor system. The ASIC 422 performs control of each motor and high-voltage power source control such as a development bias during execution of various print sequences according to an instruction from the CPU 421.

Some or all parts of the functions of the CPU 421 may be performed by the ASIC 422. On the other hand, some or all parts of the functions of the ASIC 422 may be performed by the CPU 421. Dedicated hardware is separately provided, and some of the functions of the CPU 421 and the ASIC 422 may be performed by the dedicated hardware.

<Charging/Development High-Voltage Power Source>

Figure 5A:
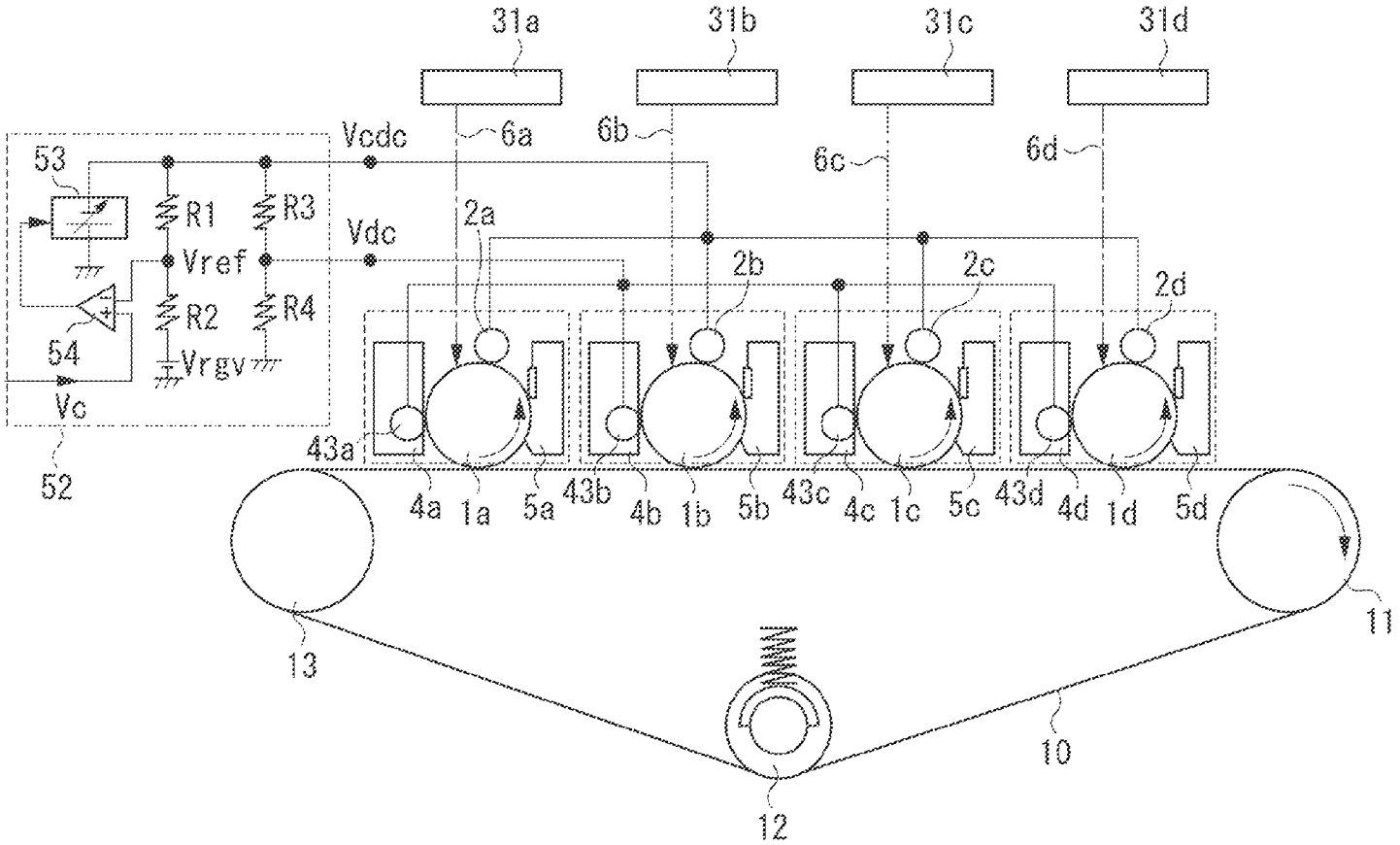
FIGS. 5A and 5B are diagrams illustrating a high-voltage power source circuit relating to a charging unit and a developing unit.
Figure 5B:
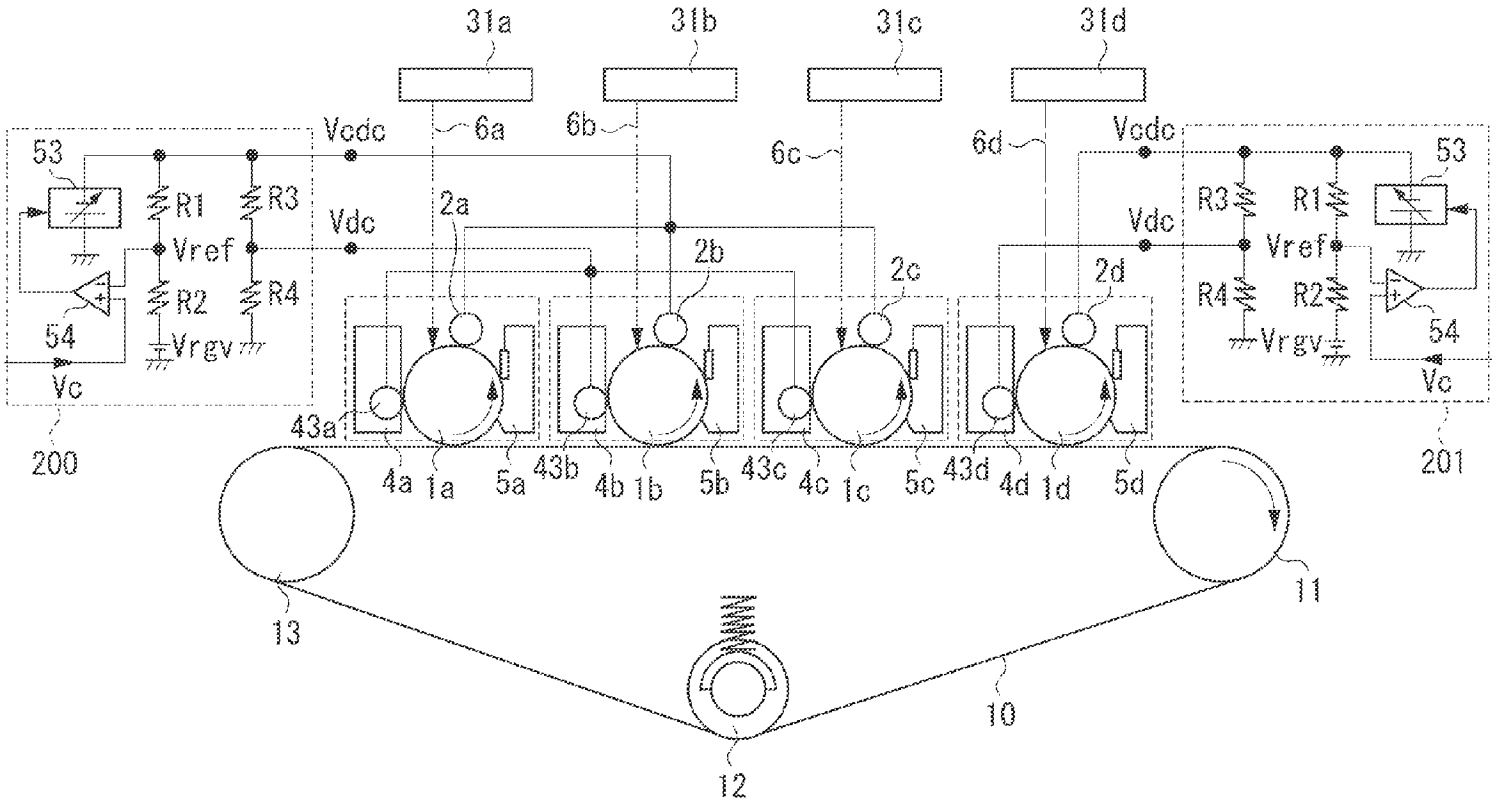

Next, referring to FIGS. 5A and 5B, the charging/developing high-voltage power source 52 will be described. FIGS. 5A and 5B illustrate an example of a charging/developing high-voltage power source. In the example illustrated in FIG. 5A, charging rollers 2*a* to 2*d* corresponding to a plurality of colors and developing rollers 43*a* to 43*d* corresponding to the plurality of colors are connected to the charging/developing high-voltage power source 52. The charging/developing high-voltage power source 52 supplies a charging voltage Vcdc (power supply voltage) output from one transformer 53 to the charging rollers 2*a* to 2*d*, and supplies a developing voltage Vdc divided by two resistance elements R3 and R4 to the developing rollers 43*a* to 43*d*. In the power source circuit illustrated in FIGS. 5A and 5B, a power source system is simplified, and thus voltages input (applied) to the rollers can be collectively adjusted while maintaining a predetermined relationship. However, independent individual adjustment (individual control) cannot be performed among the colors. The same applies to the developing rollers.

Each of the resistance elements R3 and R4 may be configured using any one of a fixed resistor, a half-fixed resistor, and a variable resistor. In FIGS. 5A and 5B, the power supply voltage itself from the transformer 53 is directly input to the charging rollers 2*a* to 2*d*, and a divided voltage obtained by dividing the voltage output from the transformer 53 by a voltage dividing resistor is directly input to the developing rollers 43*a* to 43*d*. However, this is only an example, and the present exemplary embodiment is not limited to this voltage input form. Various voltage input forms to the individual rollers (charging units or developing units) may be employed.

For example, in place of the output itself from the transformer, a converted voltage (voltage after conversion) obtained by subjecting the output to DC-DC conversion by a converter or a voltage obtained by dividing or reducing the power supply voltage or the converted voltage by an electron element having a fixed voltage reduction characteristics, may be input to the charging rollers 2*a* to 2*d*. The converted voltage obtained by subjecting the output from the transformer 53 to DC-DC conversion by the converter or the voltage obtained by dividing or reducing the power supply voltage or the converted voltage by the electron element having the fixed voltage reduction characteristics may be input to the developing rollers 43*a* to 43*d*. As the electron element having the fixed voltage reduction characteristics, for example, a resistance element or a zener diode can be used. The converter includes a variable regulator. Dividing or reducing the voltage by the electronic element includes, for example, further reducing or increasing the divided voltage.

To control the charging voltage Vcdc substantially constant, a negative voltage obtained by reducing the charging voltage Vcdc by R2/(R1+R2) is offset to a voltage of a positive polarity by a reference voltage Vrgv to be a monitor voltage Vref, and feedback control is performed so that the monitor voltage becomes a fixed value. Specifically, a control voltage Vc set beforehand by the engine control unit 104 (CPU 421) is input to a positive terminal of an operation amplifier 54, while the monitor voltage Vref is input to a negative terminal. The engine control unit 104 appropriately changes the control voltage Vc according to conditions at that time. A control/driving system of the transformer 53 is subjected to feedback control based on an output value of the operation amplifier 54 so that the monitor voltage Vref becomes equal to the control voltage Vc. The charging voltage Vcdc output from the transformer 53 is accordingly controlled to be a target value. For output control of the transformer 53, the output of the operation amplifier 54 may be input to the CPU, and a calculation result of the CPU may be reflected on the control/driving system of the transformer 53. In the present exemplary embodiment, control is performed so that the charging voltage Vcdc becomes −1100 V and the developing voltage Vdc becomes −350 V. Then, according to this control, the charging rollers 2*a* to 2*d* uniformly charge the surfaces of the photosensitive drums 1*a* to 1*d* with a charge potential Vd.

FIG. 5B illustrates another example of a charging/developing high-voltage power source. Members similar to those illustrated in FIG. 5A are denoted by similar reference numerals, and description thereof will be omitted. In FIG. 5B, power sources are divided into at least two, namely, a charging/developing high-voltage power source 200 for image forming stations of Y, M, and C, and a charging/developing high-voltage power source 201 for an image forming station of Bk. When image formation is performed in a full-color mode, the charging/developing high-voltage power sources 200 and 201 are turned ON. On the other hand, when image formation is performed in a monochrome mode, the charging/developing high-voltage power source 201 for the image forming station of Bk is turned ON while the charging/developing high-voltage power source 200 for the image forming station of Y, M, and C is not operated (OFF). FIG. 5B is similar to FIG. 5A in terms of the charging/developing high-voltage power source 200 for the image forming station of Y, M, and C.

Thus, according to the charging/developing high-voltage power sources illustrated in FIGS. 5A and 5B, the high-voltage power source is made common among the plurality of charging rollers or developing rollers, enabling further reduction in size of the apparatus. A transformer having a variable output voltage is provided for each color, and thus reduction in cost can be achieved as compared with a case of individually controlling input voltages to the respective charging units or the respective developing units. A DC-DC converter (variable regulator) is provided for each charging unit or each developing unit, and thus reduction in cost can be achieved as compared with a case of individually controlling outputs from one transformer to the respective charging units or the respective developing units.

The configuration of the image forming apparatus has been described. Hereinbelow, referring to FIGS. 6 to 9B, based on the configuration illustrated in FIGS. 1 to 5B, a case of causing each exposure unit (light irradiation unit) to perform microexposure on a place where a toner image is not to be visualized will be described. A case of causing each exposure unit to perform normal emission further including a light amount based on image data for image formation in addition to a light amount of microemission on a place (image portion) where the toner image is visualized (adhered) will also be described. As a representative, a configuration and an operation of an exposure unit 3*a* in the first image forming station will mainly be described. However, configurations and operations are similar among exposure units 3*b* to 3*d* of the second to fourth image forming stations.

<Normal Exposure and Microexposure Operations>

Figure 6:
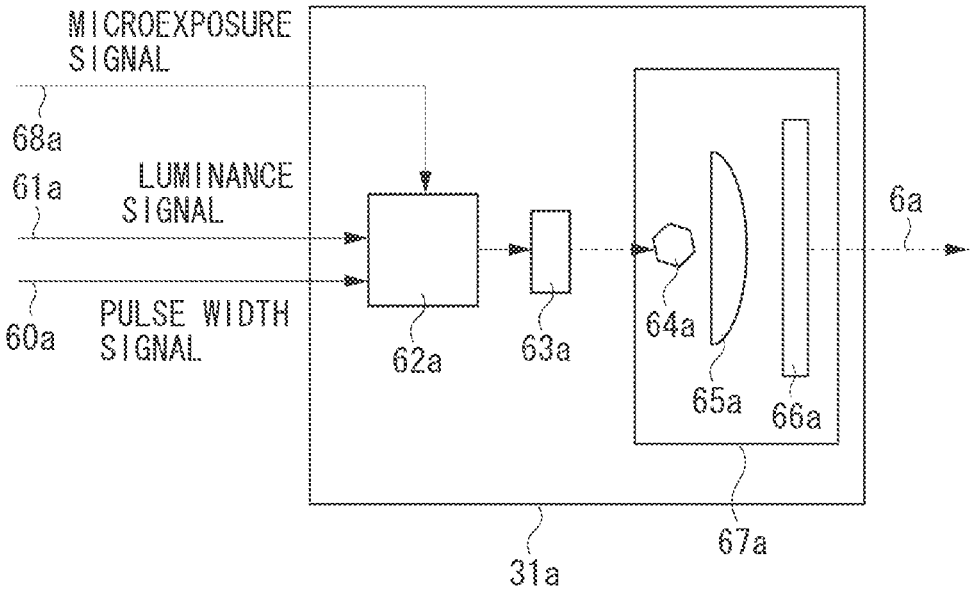
FIG. 6 is a diagram illustrating an exposure unit that has a microexposure function.

Next, referring to FIG. 6, microexposure control of a laser beam 6*a* performed by the exposure unit 3*a* on the place (nonimage portion) where the toner image on the photosensitive drum 1*a* is not visualized (adhered) will be described. For microexposure control on the photosensitive drums 1*b* to 1*d*, a configuration similar to that illustrated in FIG. 6 is provided, and detailed description thereof will be omitted.

First, an operation of the engine control unit 104 will be described. The engine control unit 104 controls, during exposure for forming an electrostatic latent image on the photosensitive drum, an exposure amount E0 for microexposure when a background portion where the toner image is not visualized is subjected to exposure based on a microexposure signal 68*a*. The engine control unit 104 controls an exposure amount (first exposure amount) Ex for the normal exposure used for exposure of the portion where the toner image is visualized based on a pulse width signal 60*a*. The pulse width signal 60*a* is a signal corresponding to the image data output from the video controller 103. The control based on the microexposure signal 68*a* and the pulse width signal 60*a* is specifically emission time control. A laser driver 62*a* includes an OR circuit. The OR circuit performs OR processing on a pulse signal by the microexposure signal 68*a* and a pulse signal by the pulse width signal 60*a*. The laser driver 62*a* drives the laser diode 63*a* to emit light based on the pulse signals subjected to the OR processing. The engine control unit 104 controls emission intensity of the laser driver 62*a* based on a luminance signal 61*a*.

The exposure amount is represented by $\mu J/cm^2$ as described above. Specifically, the exposure amount is light energy per unit area when the laser diode 63*a* continuously emits light with a certain emission intensity, for a certain period of time, and in a certain area. However, in practice, during the exposure on the background portion (nonimage portion) where toner is not adhered, the entire region is irradiated with light from the laser diode 63*a* not uniformly but intermittently. In this case, the exposure amount can be substantially regarded as average light energy (μJ) per unit area. Depending on response characteristics of the laser diode 63*a*, when pulse driving time is short, a peak value of a light pulse is decreased, and substantially control of emission intensity is performed. This factor also affects the average light energy (μJ). For example, by changing a pulse width $PW_{MIN}$ during the background exposure (microexposure) or laser emission intensity of the laser diode 63*a*, a substantial exposure amount ($\mu J/cm^2$) can be adjusted/controlled. An actual exposure amount is affected by characteristics of a correction optical system 67*a* in a direction for reducing the exposure amount E. In the present exemplary embodiment, emission conditions of the laser diode 63*a* including this point are set. It is obvious, however, that irrespective of the influence level of the characteristics of the correction optical system 67*a*, the exposure amount E is variable depending on the emission time and intensity of the laser diode 63*a*.

The pulse width signal 60*a* will be described in detail. The signal is, for example, a signal represented by image data of a multivalued signal (0 to 255) of 8 bits (=256 gradations) and used for determining laser emission time. A pulse width is $PW_{MIN}$ (e.g., 12.0% of 1 pixel) when a gradation value of the image data is 0 (background portion), and a pulse width is equal to one pixel ($PW_{255}$) with full exposure at 255. When the gradation value of the image data is 1 to 254, for example, between $PW_{MIN}$ and $PW_{255}$, a pulse width ($PW_x$) proportional to the gradation value of the image data is generated. A pulse width with respect to the image data of an arbitrary gradation value n (=0 to 255) is determined by the following expression (1).

$$PW_n = n \times PW_{255} - PW_{MIN})/255 + PW_{MIN} \quad (1)$$

According to the expression (1), $PW_0 = PW_{MIN}$ is established when n=0, and $PW_{255}$ is established when n=255. The case where the image data for controlling the laser diode 63*a* is 8 bits (=256 gradations) is an example. The image data can be, for example, a multivalued signal of 4 bits (=16 gradations) or 2 bits (4 gradations) after halftone processing. The image data after the halftone processing may be a binarized signal.

The engine control unit 104 changes the microexposure signal 68*a* and the luminance signal 61*a* according to a remaining life of the photosensitive drum, and controls a microexposure amount (second exposure amount) E0 of the background portion to an appropriate value. A width of a pulse signal output according to an instruction from the microexposure signal 68*a* of the engine control unit 104 basically coincides with the pulse width $PW_{MIN}$ (e.g., 12.0% of 1 pixel) when the image data is 0 (background portion). However, a back-calculation exposure amount E0 (pulse width) back-calculated from an exposure amount (pulse width) of image data other than 0 when the image data (density) is 0 does not always need to coincide with the microexposure amount (pulse width $PW_{MIN}$) when the image data is 0. If an average surface potential per pixel does not drop below a developing potential but uniform charging can be achieved when microexposure is performed, it is clear that for the back-calculation exposure amount E0 and the microexposure amount, certain effects can be obtained even when values approximate to each other are set.

As described above, the microexposure amount E0 is set according to characteristics of the photosensitive drum to achieve potential attenuation where uniform charging described below can be obtained while the average surface potential per pixel obtained during exposure does not drop below the developing potential (e.g., about −400 V). In the case of the E curve illustrated in FIG. 3, by outputting the $PW_{MIN}$ at 12.0% of one pixel $PW_{255}$ according to an instruction from the engine control unit 104, an initial microexposure amount E0 is set to 0.03 $\mu J/cm^2$, and thus potential attenuation of 100 V of the background portion is obtained. A maximum exposure amount E255 in the case of full exposure where exposure is performed with $MW_{255}$ is set to 0.25 $\mu J/cm^2$ that is an exposure amount in a region where the E curve illustrated in FIG. 3 is near horizontal so that variation on surface potential due to the exposure can be difficult to occur.

Then, the laser driver 62*a* controls laser emission luminance (laser emission intensity) and emission time of the laser diode 63*a* based on the luminance signal 61*a* instructed from the engine control unit 104, the pulse width signal 60*a* based on the image signal, and the microexposure signal 68*a*. The laser driver 62*a* controls current to be supplied to the laser diode 63*a* so that target emission luminance (mW) can be achieved by performing automatic light amount control. The emission luminance can be controlled by adjusting the current supplied to the laser diode 63*a* by the laser driver 62*a*. Further, a laser beam emitted from the laser diode 63*a* is subjected to light scanning, and applied to the photosensitive drum 1*a* via the correction optical system 67*a* including a polygon mirror 64*a*, a lens 65*a*, and a folding mirror 66*a*.

As described above, by performing microemmission, a charging potential Vd_bg after correction on the nonimage portion is changed from a charging potential before correction Vd=−600 V, to −500 V. On the other hand, by performing full emission, an exposure potential Vl of the image portion is changed from the charging potential Vd=−600 V to Vl=−150 V. The same operation is performed by each laser diode 63.

Referring to FIG. 6, the example of the system for performing the exposure by the laser diode 63 has been described. However, the present exemplary embodiment is not limited to this. For example, an exposure unit can be implemented in a system that includes a light-emitting diode (LED) array. Specifically, the signal illustrated in FIG. 6 may be input to a driver for driving each LED emission element, and processing of a flowchart illustrated in FIG. 7 described below may be performed. Hereinbelow, an example of an exposure system by the laser diode 63*a* will be described.

<Necessity of Correction of Exposure Amount Corresponding to Change in Film Thickness of Photosensitive Drum>

Figure 8A:
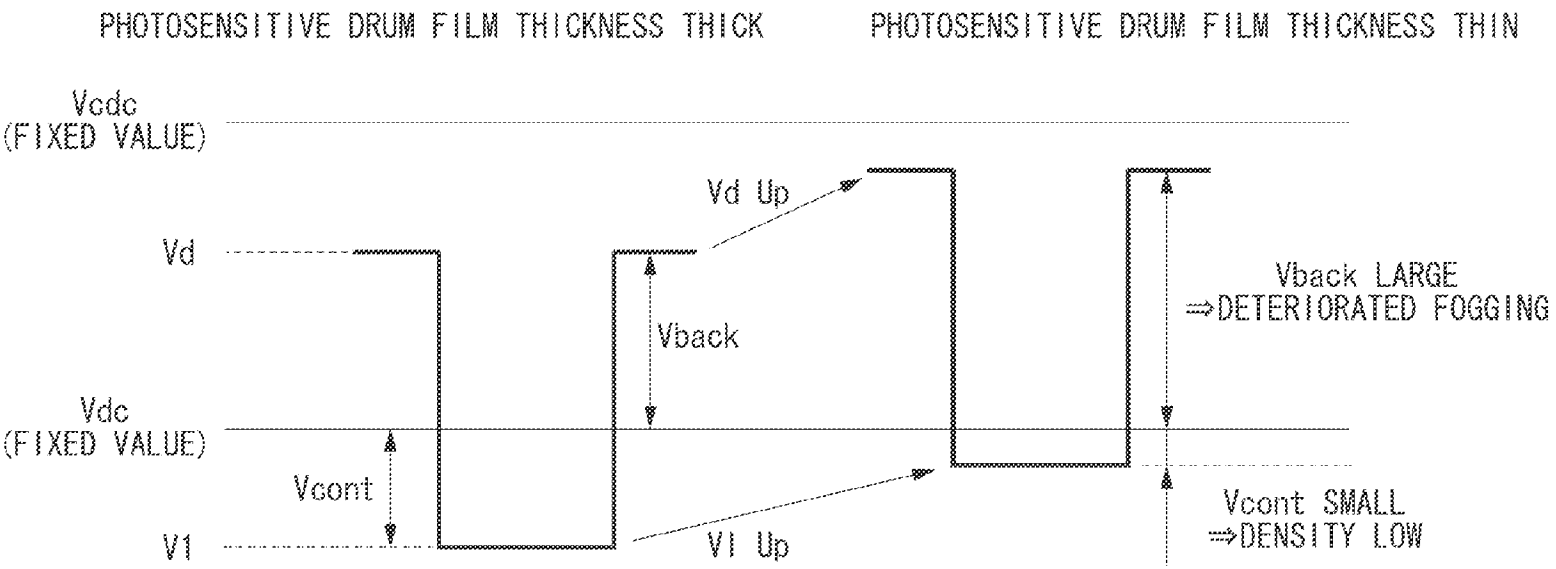
FIGS. 8A, 8B, 8C are diagrams each illustrating a relationship between a photosensitive drum film thickness and a charging potential, a developing potential, and an exposure potential.

Referring to FIG. 8A, problems relating to a difference in drum film thickness will be described. When use of the photosensitive drum progresses, the surface of the photosensitive drum is deteriorated due to electric discharging of the charging unit, and scraped by its rubbing with a cleaning unit, and its film thickness is reduced. At this time, if there are mixed photosensitive drums different in use state (e.g., accumulated number of rotations), variation occurs in film thickness among the photosensitive drums. In this state, when a certain charging potential Vcdc is applied to the plurality of photosensitive drums by the common high-voltage power source illustrated in FIGS. 5A and 5B, a potential difference generated in an air gap between the charging unit and the photosensitive drum is different. Thus, variation occurs in charging potential Vd. Specifically, since the photosensitive drum where the number of image forming times is small has a large film thickness, and a potential difference generated in the air gap between the charging unit and the photosensitive drum is small, an absolute value of the charging potential Vd is small. On the other hand, since the photosensitive drum where the accumulated number of rotations is large has a small film thickness, and a potential difference generated in the air gap between the charging unit and the photosensitive drum is large, the absolute value of the charging potential Vd is large.

For example, in the photosensitive drum having a large film thickness, when a developing potential Vdc and a charging potential Vd are set so that back contrast Vback (=Vd−Vdc) that is contrast between the developing potential Vdc and the charging potential Vd can be set in a desired state, a problem illustrated in FIG. 8A occurs. Specifically, in the image forming station including the photosensitive drum of a small film thickness, an absolute value of the charging potential Vd is increased, thereby increasing the back contrast Vback. When the back contrast Vback is large, toner (in the case of reversal development in the example, toner charged not to negative polarity but to positive polarity of 0 and more) not charged to a normal potential is transferred to the nonimage portion from the developing unit to cause fogging.

In the photosensitive drum having a small film thickness, the charging potential Vd increases. Thus, in a configuration where exposure intensity is fixed, the exposure potential Vl also increases. As a result, development contrast Vcont (=Vdc−Vl) that is a difference value between the developing potential Vdc and the exposure potential Vl is reduced, disabling sufficient electrostatic transfer of toner to the photosensitive drum from the developing unit, and a low density of a solid black image is easily generated.

Figure 8B:
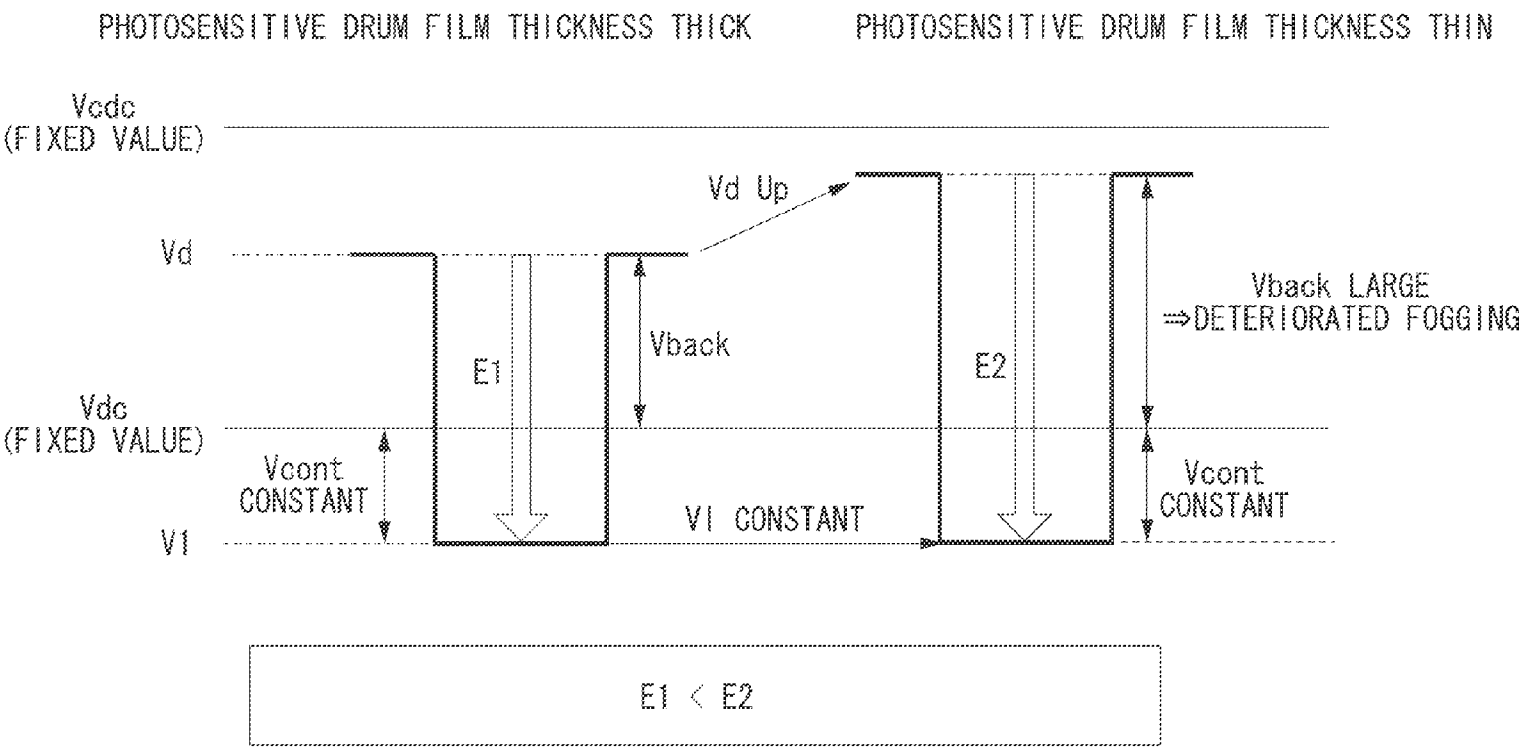

On the other hand, as illustrated in FIG. 8B, when the developing voltage and the charging voltage are fixed, and the normal exposure amount is changed from E1 to E2, a development contrast Vcont that is a difference value between the developing potential Vdc and the exposure potential Vl can be controlled roughly constant. This enables a density to be maintained constant. However, back contrast Vback that is contrast between the developing potential Vdc and the charging potential Vd spreads, generating the problem of fogging.

<Correction of Normal Exposure Amount and Microexposure Amount>

On the other hand, in the present exemplary embodiment, for example, even in the case of the power source configuration illustrated in FIGS. 5A and 5B, the occurrence of fogging and a low density can be suppressed with a simple configuration. Hereinbelow, referring to the flowchart illustrated in FIG. 7, processing for correcting microexposure amounts E0 of the laser diodes 63*a* to 63*d* on the background portion (nonimage portion) to which toner is not adhered in association with the remaining lives of the photosensitive drums 1*a* to 1*d* and variations in charging voltage Vcdc and developing voltage will be briefly described.

First, in step S101, the engine control unit 104 reads various pieces of information for setting a normal exposure amount (first exposure amount) and a microexposure amount (second exposure amount). At this time, the engine control unit 104 reads, as information about the remaining lives of the photosensitive drums, information about the integrated number of rotations of the photosensitive drums and information about normal exposure correction amount ΔE2 and microexposure correction amount ΔEbg1 from the storage member in the image apparatus.

In step S102, the engine control unit 104 reads a normal exposure parameter corresponding to the read integrated number of rotations of the photosensitive drums by referring to a table defining correspondence between the integrated number of rotations of the photosensitive drums (use state of photosensitive drums) and a parameter relating to a normal exposure. In other words, a normal exposure amount E2 that is a target exposure amount is set. Further, a final normal exposure amount E2' is set by performing correction using the normal exposure correction amount ΔE2 described below. In the table defining the correspondence between the integrated number of rotations of the photosensitive drums (use state of photosensitive drums) and the parameter relating to the normal exposure, normal exposure is larger when the integrated number of rotations of the photosensitive drums is large.

In step S103, as is in step S102, the engine control unit 104 reads a microexposure parameter corresponding to the read integrated number of rotations of the photosensitive drums by referring to a table defining correspondence between the integrated number of rotations of the photosensitive drums (use state of photosensitive drums) and a parameter relating to microexposure. In other words, a microexposure amount Eb2g that is a target exposure amount is set. Further, a final microexposure amount Ebg2' is set by performing correction using the microexposure correction amount ΔEbg2 described below. In the table defining the correspondence between the integrated number of rotations of the photosensitive drums (use state of photosensitive drums) and the parameter relating to the microexposure, as in the case of the normal exposure, microexposure is larger when the integrated number of rotations of the photosensitive drums is large. Processing in steps S102 and S103 will be described in detail below.

In step S104, the respective members perform the series of image forming operations and control described above referring to FIG. 1 under a control instruction from the engine control unit 104 so that the normal exposure amount and the microexposure amount determined in steps S102 and S103 can be obtained. In step S105, the engine control unit measures the respective numbers of rotations of the photosensitive drums 1*a* to 1*d* rotated during the series of image forming operations. This measurement processing is performed to update the use states of the photosensitive drums. The processing in step S105 is actually performed concurrently with the processing in step S104. In step S106, the engine control unit 104 determines whether image formation has ended. When ended (YES in step S106), the processing proceeds to step S107.

In step S107, the engine control unit 104 adds the measurement result of each photosensitive drum measured in step S105 to the corresponding integrated number of rotations. In step S108, the engine control unit 104 stores the updated integrated number of rotations in the nonvolatile memory tag 32-2 of each station. Through the processing in step S106, the information about the remaining lives of the photosensitive drums is updated. As a storage destination, a storage unit different from the memory tag 32-2 may be use as described above in step S101.

Figure 8C:
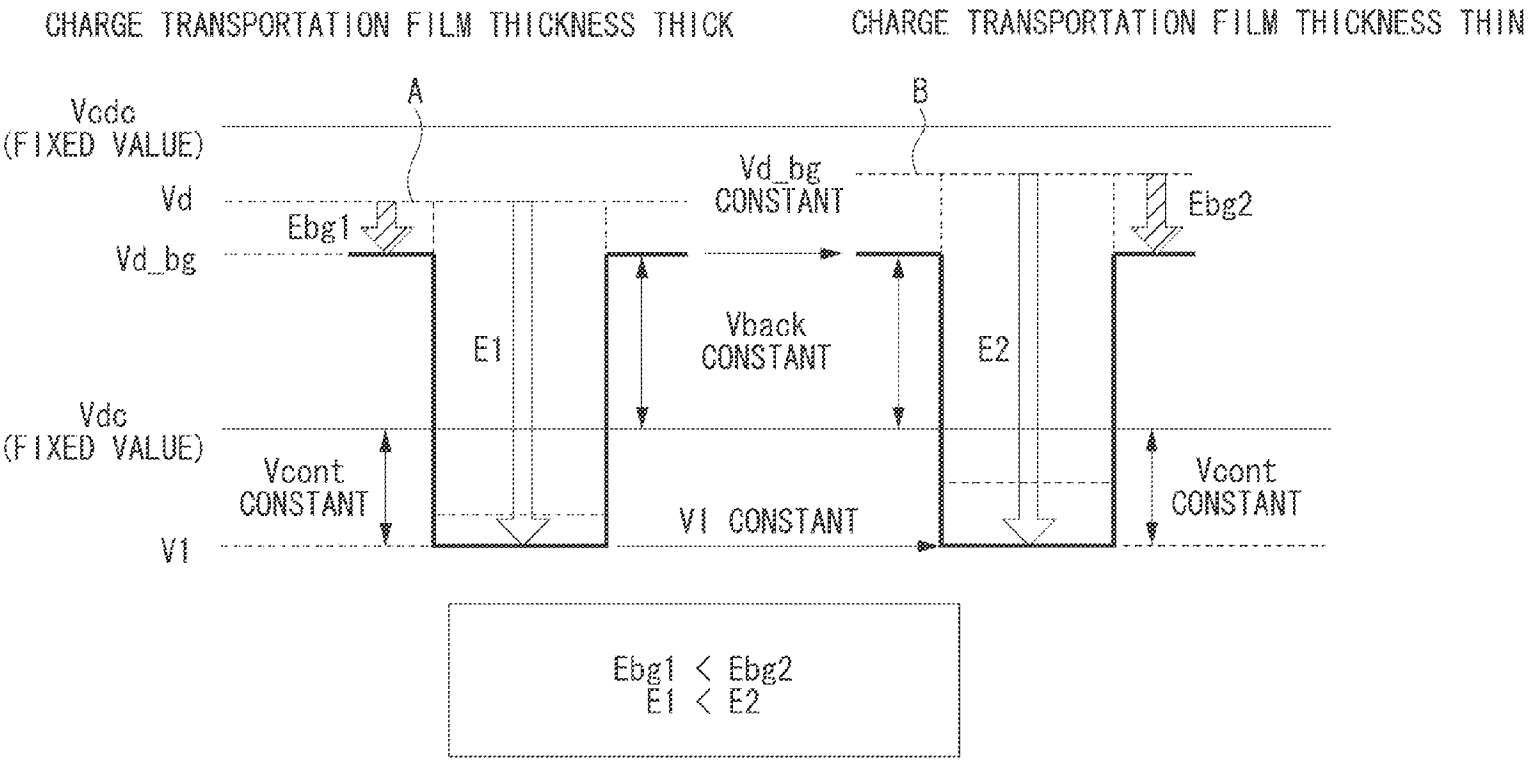

When the developing voltage and the charging voltage are fixed, and the normal exposure amount is changed from E1 to E2 to deal with a change in film thickness of the photosensitive drum as illustrated in FIG. 8C, development contrast Vcont that is a difference value between the developing potential Vdc and the exposure potential Vl can be controlled substantially constant. When a microexposure amount is changed from Ebg1 to Ebg2 to deal with the change in film thickness of the photosensitive drum, back contrast Vback that is contrast between the developing potential Vdc and the charging potential Vd can be controlled substantially constant. As described above, to deal with the change in film thickness of the photosensitive drum, the numbers of rotations of the photosensitive drums 1*a* to 1*d* are measured, and the normal exposure amount and the microexposure amount are changed based on the integrated number of rotations. However, a method for dealing with the change in film thickness of the photosensitive drum is not limited to this. For example, the normal exposure amount and the microexposure amount may be changed based on parameters relating to the change in film thickness of the photosensitive drum such as the number of pages on which images have been formed.

<Dealing with Variations in Charging Voltage and Developing Voltage>

In the present exemplary embodiment, the normal exposure amount and the microexposure amount are changed to deal with the film thicknesses of the photosensitive drums 1*a* to 1*d*. In addition, variations in the charging voltage and the developing voltage caused by an output of the charging/developing high-voltage power source are dealt with. Hereinbelow, how to deal with variations in the charging voltage and the developing voltage will be described. As described above, to control the charging voltage Vcdc illustrated in FIGS. 5A and 5B substantially constant, the feedback control where the engine control unit 104 controls the preset control voltage Vc is performed. Even if this control is performed, variation occurs in the charging voltage Vcdc due to variations in resistance elements R1 and R2 and the reference voltage Vrgv. Variation occurs on the developing voltage Vdc between the devices due to variations on resistance elements R3 and R4.

Figure 9A:
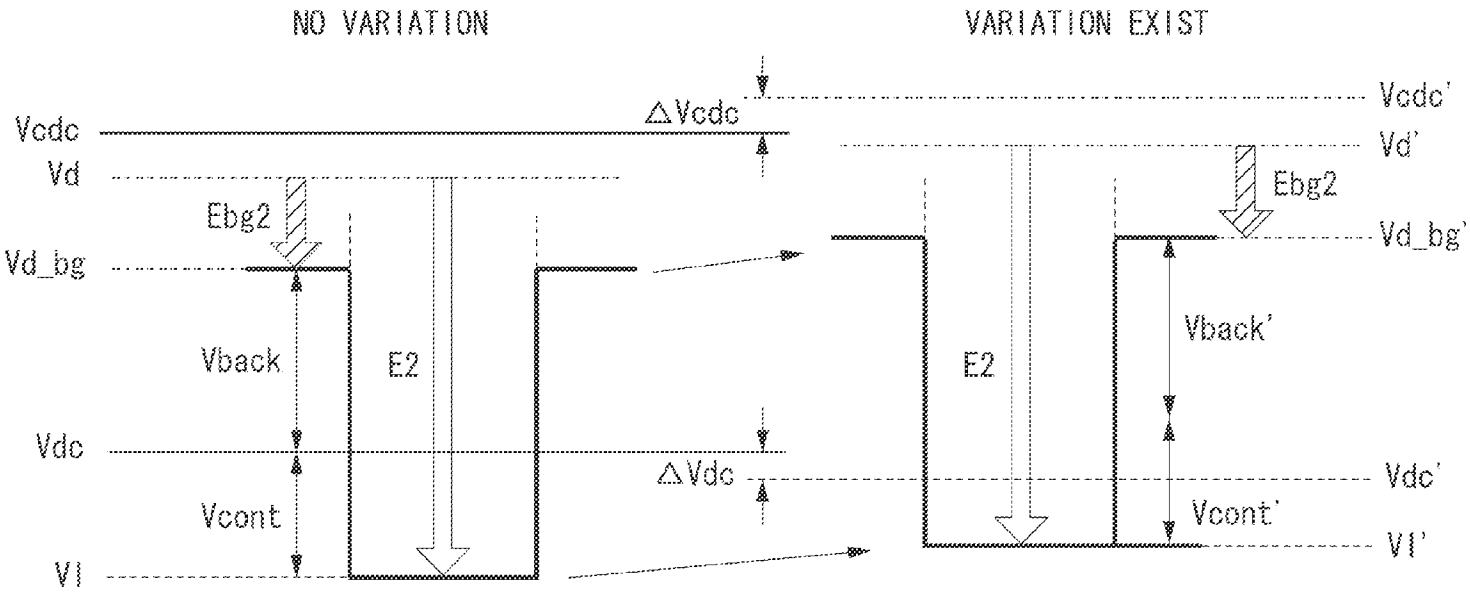
FIG. 9A is a diagram illustrating a relationship between variations in a charging potential and a developing potential, and an exposure potential.

As a result, depending on the degree of the variations in the charging voltage Vcdc and the developing voltage Vdc, desired development contrast Vcont and desired back contrast Vb may not be obtained. FIG. 9A is a diagram illustrating comparison between a case where there is no variation in the charging voltage Vcdc and the developing voltage Vdc and a case where there are variations therein. FIG. 9A illustrates a normal exposure amount E2 and a microexposure amount Ebg2 to deal with the change in film thickness of the photosensitive drum. In this case, since actually the charging voltage is Vcdc' and the developing voltage is Vdc', actual development contract is varied to Vcont' (≠Vcont), and actual back contrast is deviated to Vback' (≠Vback). As a result, depending on circumstances, there may be a possibility of image failures, such as fogging where toner is transferred to the non-image portion and impossibility of setting an appropriate density at the image portion. Such variations in development contract and back contract may similarly occur at the initial use of the photosensitive drum having a large film thickness.

Thus, to reduce variations in the charging voltage Vcdc and the developing voltage Vdc, the resistance elements on the charging/developing high-voltage power source circuit may be changed to variable resistance elements, and output adjustment may be performed by volume adjustment. However, in the case of performing the output adjustment of the charging voltage Vcdc and the developing voltage Vdc, there may be a possibility that the number of steps will increase during manufacturing the image forming apparatus, causing productivity deterioration and a cost increase. When the output adjustment step is performed, the adjustment can be carried out with a certain level of accuracy. However, variation equal to tolerance remains in the output adjustment step.

Thus, according to the present exemplary embodiment, the variations in the charging voltage Vcdc and the developing voltage Vdc are dealt with by a method different from that of the output adjustment based on the volume adjustment, and variations in the development contrast Vcont and the back contrast Vback are reduced.

<Setting of Correction Values of Exposure Amount to Deal with Variations in Charging Voltage and Developing Voltage>

Hereinbelow, referring to a flowchart illustrated in FIG. 10, setting of correction values of a normal exposure amount and a microexposure amount by the engine control unit 104 to deal with variations in the charging voltage Vcdc and the developing voltage Vdc will be described. The control described below is performed during manufacturing the image forming apparatus.

First, in step S201, the engine control unit 104 controls the charging voltage Vcdc to be a target value by a predetermined control voltage Vc.

In step S202, a charging voltage Vcdc' and a developing voltage Vdc' during the control in step S201 are measured by a high-voltage measurement device (measurement unit, not illustrated). Specifically, output voltages from contacts (not illustrated) for the charging rollers 2*a* to 2*d* of the charging/developing high-voltage power source 52 and contacts (not illustrated) for the developing rollers are measured. The measuring method is not limited to this. Values relating to the charging voltage Vcdc' and the developing voltage Vdc' may be calculated by measuring resistance values of the respective resistance elements R1 to R4. In any case, the charging voltage Vcdc' and the developing voltage Vdc' take values affected by variation on components.

In step S203, the charging voltage Vcdc' and the developing voltage Vdc' measured in step S202 are stored in the nonvolatile storage unit 424 in the engine control unit 104. As data stored in the nonvolatile storage unit 424, any data can be used as long as it is characteristic data indicating a relationship between the control voltage Vc and the charging voltage Vcdc' or the developing voltage Vdc'. The nonvolatile storage unit 424 is desirably mounted on the substrate for generating the charging voltage and the developing voltage.

In step S204, the engine control unit 104 calculates a charged difference voltage ΔVcdc and a development difference voltage ΔVdc represented by the following expressions by using the charging voltage Vcdc' and the developing voltage Vdc' stored in the nonvolatile storage unit 424 and the charging voltage Vcdc and the developing voltage Vdc that are target voltages stored beforehand in the nonvolatile storage unit 424.

$$\Delta Vcdc' = Vcdc' - Vcdc \quad (2)$$

$$\Delta Vdc' = Vdc' - Vdc \quad (3)$$

In step S205, the engine control unit 104 calculates a contrast correction voltage ΔV represented by the following expression from the charged difference voltage ΔVcdc and the development difference voltage ΔVdc calculated in step S204.

$$\Delta V = \Delta Vcdc - \Delta Vdc \quad (4)$$

The calculated contrast correction voltage ΔV is information about a difference between the charging voltage Vcdc' output from the charging unit and a desired charging voltage Vcdc, and also information about a difference between the development Vdc' output from the developing unit and a desired developing voltage Vdc.

In step S206, the engine control unit 104 refers to a table defining correspondence between a contrast correction voltage and a normal exposure correction amount, and a microexposure correction amount illustrated in FIG. 11. The engine control unit 104 selects and obtains a normal exposure correction amount ΔE based on the contrast correction voltage ΔV calculated in step S205, and stores it as a correction value for a normal exposure amount in the nonvolatile storage unit 424 (storage unit). Accordingly, the setting of the normal exposure correction amount ΔE is completed. The normal exposure correction amount ΔE is a correction amount for correcting a normal exposure amount E, and a value obtained by setting the normal exposure amount E that is a target exposure amount or its related value as a variable.

In step S207, as in the case of step S206, the engine control unit 104 refers to the table defining correspondence between the contrast correction voltage and the normal exposure correction amount, and the microexposure correction amount illustrated in FIG. 11. The engine control unit 104 selects and obtains a microexposure correction amount ΔEbg based on the contrast correction voltage ΔV calculated in step S205, and stores it as a correction value for a microexposure amount in the nonvolatile storage unit 424 (storage unit). Accordingly, the setting of the microexposure correction amount ΔEbg is completed. The microexposure correction amount ΔEbg is a correction amount for correcting a microexposure amount E, and a value obtained by setting the microexposure amount Ebg that is a target exposure amount or its related value as a variable.

Thus, through the processing of the steps S206 and S207, the normal exposure correction amount ΔE and the microexposure correction amount ΔEbg can be appropriately set based on the information about the difference between the charging voltage Vcdc' output from the charging unit and the desired charging voltage Vcdc, and also the information about the difference between the developing voltage Vdc' output from the developing unit and the desired developing voltage Vdc. In steps S206 and S207, the calculation is performed based on the voltage values such as the charging voltage, the developing voltage, the difference voltage, or the contrast correction voltage. However, the calculation can be performed by using any value as long as it is a value related to the voltage value. It has been descried that in steps S206 and S207 the engine control unit 104 refers to the table relating to the contrast correction voltage illustrated in FIG. 11. However, the present invention is not always limited to this form. For example, by calculation of the CPU 421 based on a calculation formula, the normal exposure correction amount ΔE and the microexposure correction amount ΔEbg can be obtained from parameters relating to the contrast correction voltage. The contrast correction voltage is not limited to that obtained by the expression (4). For example, a value relating to the charged difference voltage ΔVcdc and a value relating to the development difference value ΔVdc are respectively weighted at predetermined ratios, and subtracted or added. Then, the result is calculated as a parameter relating to the contrast correction voltage. The normal exposure correction amount ΔE and the microexposure correction amount ΔEbg may not be always calculated in the engine control unit 104. In other words, the normal exposure correction amount ΔE and the microexposure correction amount ΔEbg may be selected or calculated by an external calculation unit by using the charging voltage and the developing voltage measured by the high-voltage measurement device (measurement unit) and using the table or calculation. Then, the calculated normal exposure correction amount ΔE and the microexposure correction amount ΔEbg can be received from the external calculation unit to be stored in the storage unit such as the nonvolatile storage unit 424, thereby setting the normal exposure correction amount ΔE and the microexposure correction amount ΔEbg. In other words, information about the normal exposure correction amount ΔE and the microexposure correction amount ΔEbg selected or calculated based on the values of the charging voltage and the developing voltage measured by the measurement unit only needs to be stored in the storage unit in the apparatus.

<Correction Method of Exposure Amount to Deal with Variations in Charging Voltage and Developing Voltage>

Next, setting changes of a parameter relating to normal exposure and a parameter relating to microexposure using the normal exposure correction amount ΔE and the microexposure correction amount ΔEbg stored in the nonvolatile storage unit 424 (storage unit) to be set will be described. Such setting changes are performed in steps S102 and S103 of the flowchart illustrated in FIG. 7.

Figure 7:
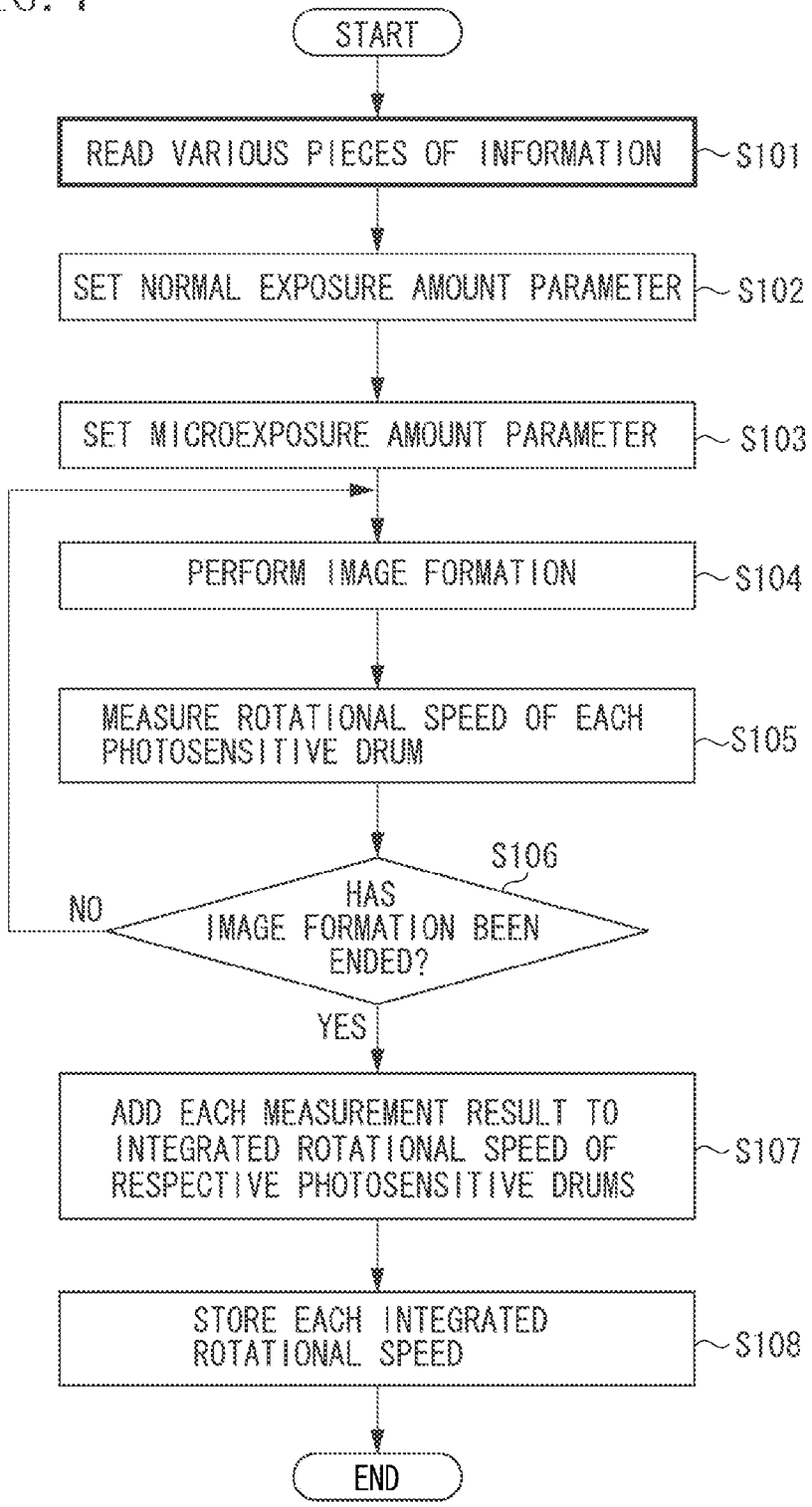
FIG. 7 is a flowchart illustrating setting processing of a microexposure parameter and a normal exposure parameter, image forming processing, and updating processing of a photosensitive drum using state.

In steps S102 and S103 of the flowchart illustrated in FIG. 7, the engine control unit 104 reads parameters of normal exposure and microexposure corresponding to the integrated number of rotations of the photosensitive drums by referring to the table defining the correspondence between the integrated number of rotations of the photosensitive drums and the parameters relating to the normal exposure, and sets a target exposure amount of the normal exposure amount to E2 and the target exposure amount of the predetermined microexposure amount to Ebg2 beforehand. Then, the engine control unit 104 corrects, concerning normal exposure, the normal exposure amount E2 by using the normal exposure correction amount ΔE to calculate and set a normal exposure amount E2'. The engine control unit 104 corrects, concerning microexposure, the microexposure amount Ebg2 by using the microexposure correction amount ΔEbg to calculate and set a microexposure amount Ebg2'.

Specifically, the normal exposure amount E2' and the microexposure amount Ebg2' are respectively calculated based on the following expressions (5) and (6).

$$E2'=E2+\Delta E \tag{5}$$

$$Ebg2'=Ebg2+\Delta Ebg \tag{6}$$

The normal exposure amount E2 and the microexposure amount Ebg2 thus set are corrected by using the normal exposure correction amount ΔE and the microexposure correction amount ΔEbg. As a result, the predetermined normal exposure correction amount ΔE2 and the predetermined microexposure ΔEbg2 can be corrected based on the information about the difference between the charging voltage Vcdc' output from the charging unit and the desired charging voltage Vcdc, and the information about the difference between the development Vdc' output from the developing unit and the desired developing voltage Vdc.

Then, the engine control unit 104 sets luminance signals 61*a* to 61*d* so as to cause the laser diodes 63*a* to 63*d* to normally emit light to achieve a normal exposure amount E2'. The engine control unit 104 also sets microexposure signals 68*a* to 68*d* so that the laser diodes 63*a* to 63*d* can emit microlight to obtain a microexposure amount Ebg2'.

<Calculation Method of Luminance Signal and Microexposure Signal>

Next, a calculation method of a luminance signal and a microexposure signal will specifically be described. As an example, the luminance signal 61*a* and the microexposure signal 68*a* will be described. The same applies to the luminance signals 61*b* to 61*d* and the microexposure signals 68*b* to 68*d*, and thus description thereof will be omitted.

Figure 10:
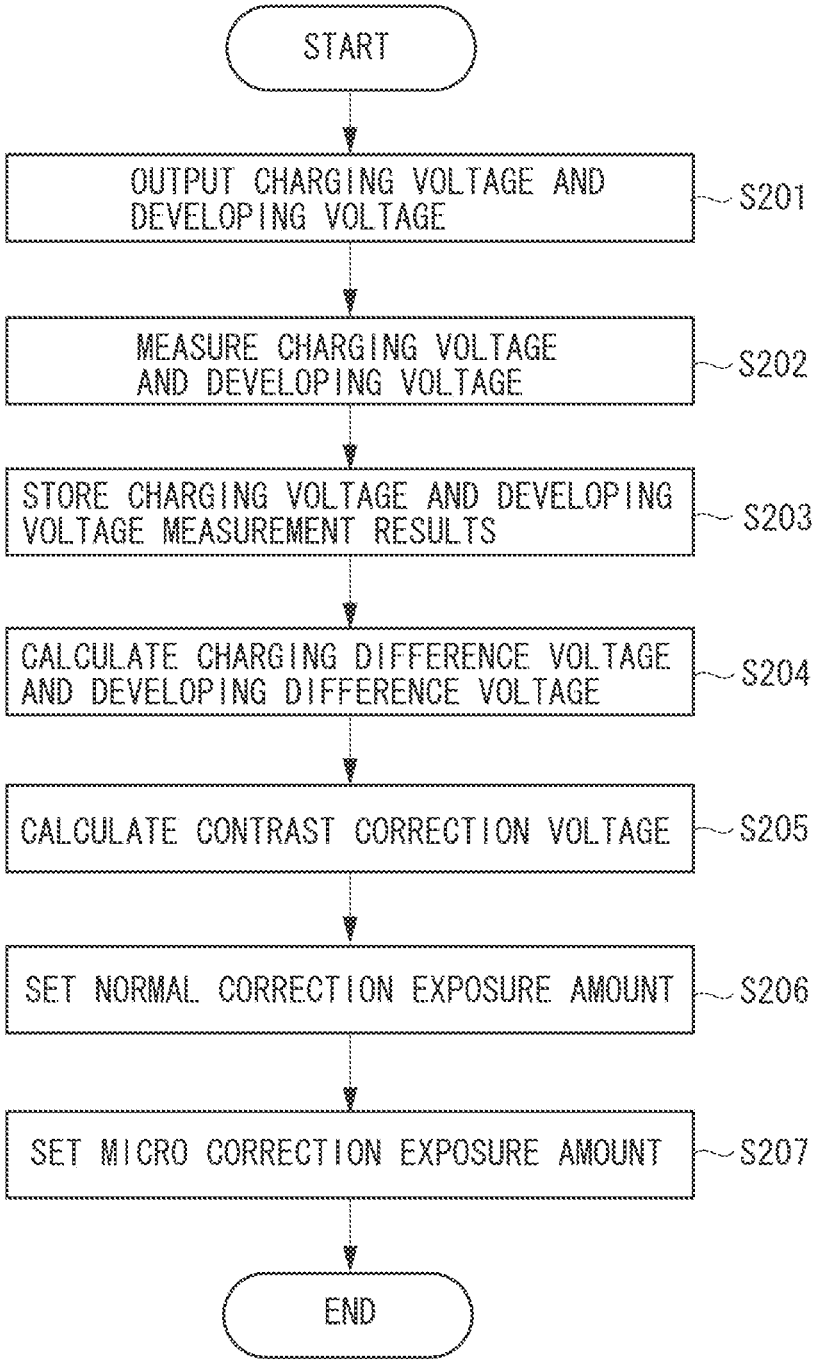
FIG. 10 is a flowchart illustrating processing for correcting variations in a charging voltage Vcdc and a developing voltage Vdc by controlling the normal exposure amount and the microexposure amount.

For example, when the contrast correction voltage ΔV is −4 V in step S205 illustrated in FIG. 10, the normal exposure correction amount ΔE illustrated in FIG. 11 is 0.04E2. It is assumed that the normal exposure amount E2 as a target exposure amount is 0.3 (μJ/cm$^2$). The engine control unit 104 calculates the normal exposure amount E2' based on the expression (5).

$$E2'=E2+0.04E2=0.312((\mu J/cm^2)$$

Thus, the normal exposure amount E2 is calculated to be 0.312 (μJ/cm$^2$).

Figure 12A:
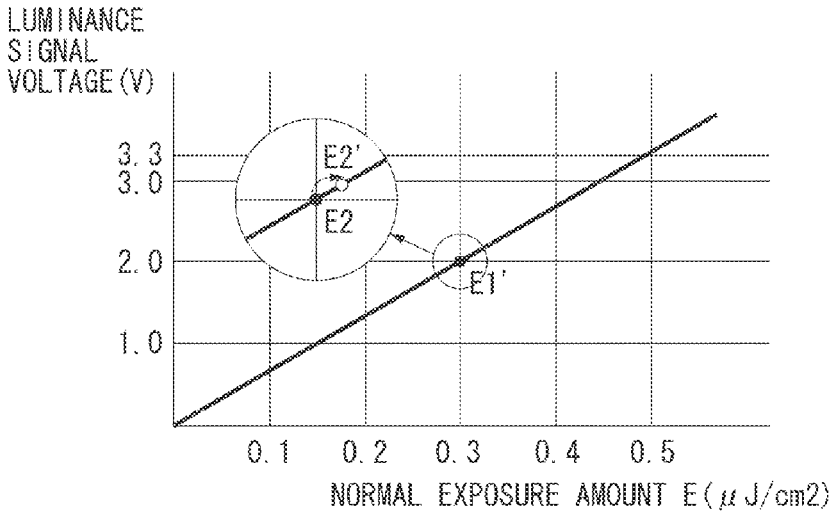
FIGS. 12A and 12B are graphs respectively illustrating a relationship between a normal exposure amount and a luminance signal voltage, and a relationship in PWM DUTY between a microexposure amount and a microexposure signal.

FIG. 12A is a diagram illustrating a relationship between the normal exposure amount and the luminance signal voltage. The engine control unit 104 stores the relationship between the normal exposure amount and the luminance signal voltage illustrated in FIG. 12A beforehand. Then, the engine control unit 104 calculates a luminance signal voltage to emit light by the calculated normal exposure amount E2. In the relationship illustrated in FIG. 12A, a luminance signal voltage of 2.0 V is necessary to satisfy the normal exposure amount of 0.312 (μJ/cm$^2$). Thus, a luminance signal voltage to satisfy the normal exposure amount E2 (=0.312 μJ/cm$^2$) is 2.0 (V)×0.312 (μJ/cm$^2$)/0.3 (μJ/cm$^2$)=2.08 (V). Then, the engine control unit 104 outputs a luminance signal 61 so that the luminance signal voltage can be 2.08 V, and causes the laser diode 63 to normally emit light so that the normal exposure amount can be equal to the normal exposure amount E2 (=0.312 μJ/cm$^2$).

Figure 12B:
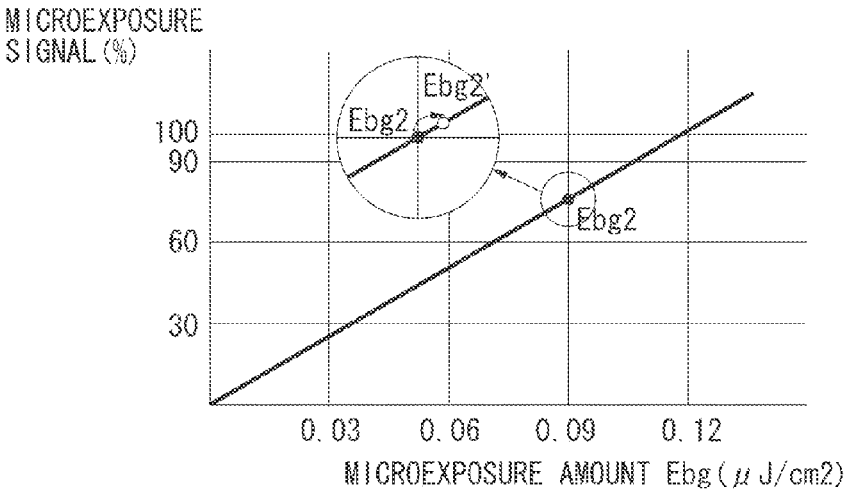

Next, a method for calculating a PWM duty of the microexposure signal 68*a* corresponding to the microexposure amount Ebg1 set during the processing of step S207 illustrated in FIG. 10 will be described. The PWM duty of the microexposure signal 68*a* is a value for determining a pulse width ($PW_{MIN}$) when a gradation value of the image data is 0 (background portion). As the PWM duty of the microexposure signal 68*a* is larger, the pulse width ($PW_{MIN}$) when the gradation value of the image data is 0 (background portion) is larger. FIG. 12B is a diagram illustrating a relationship between the microexposure amount and the PWM duty of the microexposure signal 68*a*. For example, when the contrast correction voltage ΔV is −4 V in step S205 illustrated in FIG. 10, the microexposure correction amount ΔEbg illustrated in FIG. 11 is 0.04 Ebg2. It is assumed that the microexposure amount Ebg2 as a target exposure amount is 0.9 (μJ/cm$^2$). The engine control unit 104 calculates the microexposure amount Ebg2' based on the expression (6).

$$Ebg2'=Ebg2+0.04Ebg2=1.04Ebg2=0.0936(\mu J/cm^2)$$

Thus, the microexposure amount Ebg2' is calculated to be 0.0936 (μJ/cm$^2$). The engine control unit 104 stores the relationship between the microexposure amount and the duty of the microexposure signal 68*a* illustrated in FIG. 12B beforehand. Then, since a PWM duty of 75% of the microexposure signal 68*a* is necessary to satisfy the microexposure amount of 0.09 (μJ/cm$^2$), the engine control unit 104 calculates a PWM duty of the microexposure signal 68*a* to satisfy the microexposure amount of 0.093 (μJ/cm$^2$) based on the relationship illustrated in FIG. 12B. The PWM duty of the microexposure signal 68*a* to satisfy the microexposure amount of 0.093 (μJ/cm$^2$) is 75(%)×0.093 (μJ/cm$^2$)/0.09 (μJ/cm$^2$)=77.5(%). Then, the engine control unit 104 outputs a microexposure signal 68*a* having a PWM duty of 77.5(%), and causes the laser diode 63 to emit microlight so that the microexposure amount Ebg2' (=0.0936 μJ/cm$^2$) can be obtained.

In the present exemplary embodiment, the normal exposure amount and the microexposure amount are changed to deal with the change in film thickness of the photosensitive drum, and then correction is performed according to the variations in the developing voltage and the charging voltage. However, a correction method is not limited to this. The normal exposure amount and the microexposure amount may first be corrected according to the variations in the developing voltage and the charging voltage, and then the normal exposure amount and the microexposure amount may be changed to deal with the change in film thickness of the photosensitive drum.

In the present exemplary embodiment, the setting of the correction values of the normal exposure amount and the microexposure amount to deal with the variations in the charging voltage and the developing voltage is performed during the manufacturing the image forming apparatus. However, the present invention is not limited to this. A measurement unit for measuring the charging voltage and the developing voltage may be provided in the apparatus. The charging voltage and the developing voltage may be measured by the measurement unit, and correction values may be set based on the result. Measurement timing by the measurement unit only needs to be before an image forming operation such as initial operation time of the image forming apparatus. Measurement may be periodically performed to update the correction values, for example, after replacement of the photosensitive drum or performance of a job by a predetermined amount.

<Operation/Effect>

Figure 9B:
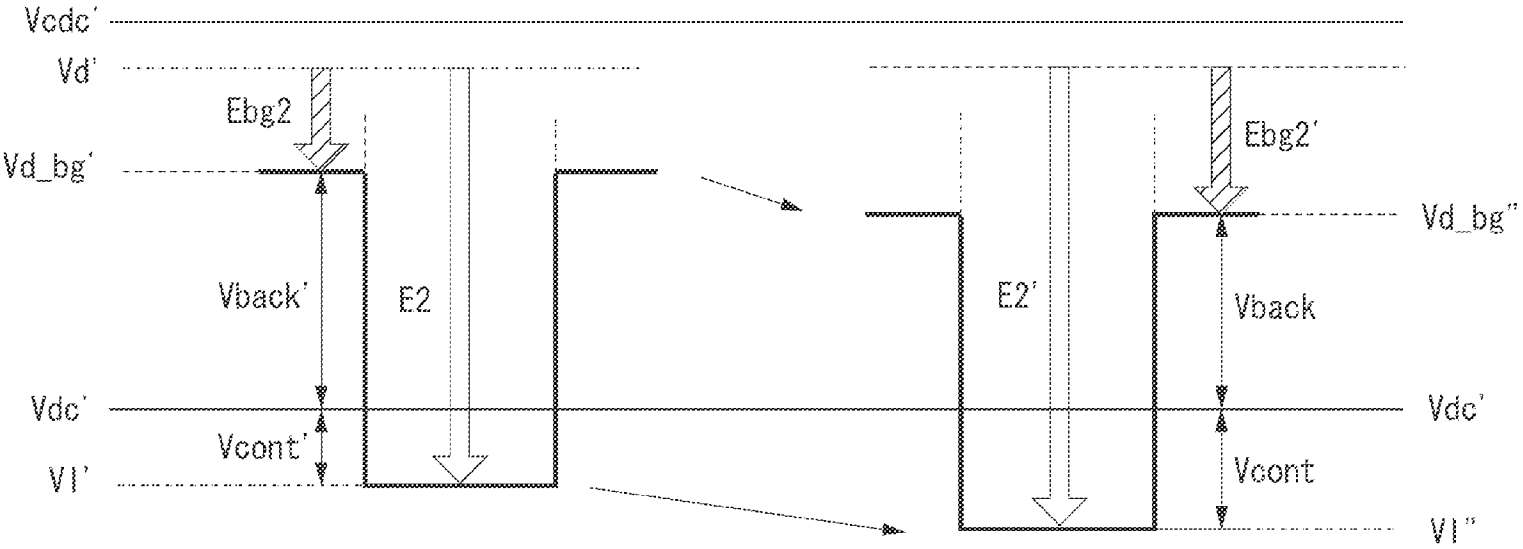
FIG. 9B is a diagram illustrating a relationship between a charging potential and a developing potential, and an exposure potential based on whether correction of a normal exposure amount and a microexposure amount are performed.

FIG. 9B is a diagram illustrating a relationship between the charging potential, the developing potential, and the exposure potential based on presence or absence of correction of the normal exposure amount and the microexposure amount. As illustrated in FIG. 9B, by correcting the normal exposure amount and the microexposure amount based on information about the variations in the charging voltage and the developing voltage, the charging potential, the developing potential, and the exposure potential of the photosensitive drum are optimized, and the development contrast and the back contrast can be optimized. As a result, image failures can be suppressed.

A second exemplary embodiment is different from the first exemplary embodiment in that a developing voltage Vdc is set to a target value in advance. Thus, only the difference from the first exemplary embodiment will be described. Description of other similar components will be omitted.

Referring to a flowchart illustrated in FIG. 13, correction of a normal exposure amount and a microexposure amount to deal with variations in a charging voltage Vcdc and a developing voltage Vdc will be described.

First, in step S301, an engine control unit 104 changes a control voltage Vc set beforehand, and performs control to set a developing voltage Vdc' including variation to a target value Vdc. The target value Vdc is a fixed value determined in advance.

In step S302, a charging voltage and a developing voltage during the control in step S301 are measured by a high-voltage measurement device. A measured charging voltage Vcdc' is a value affected by variation on components. A measured developing voltage Vdc" is set to a value controlled to be a target value Vdc by a further change of the control voltage Vc from a state including variation.

In step S303, it is determined whether the developing voltage Vdc" measured in step S302 is equal to the developing voltage Vdc that is a target voltage. The developing voltage Vdc" does not need to be always equal to the developing voltage Vdc. For example, an acceptable range of |Vdc"−Vdc|≤0.1 V may be set. When not equal (NO in step S303), the processing proceeds to step S304.

Figure 14:
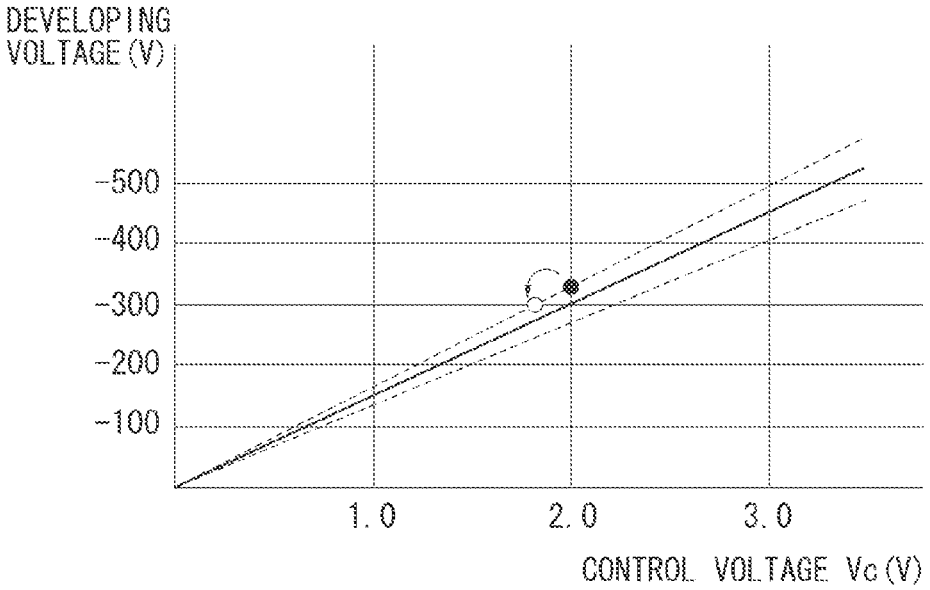
FIG. 14 is a diagram illustrating a relationship between a control voltage and a developing voltage.

In step S304, correction of the control voltage Vc for the charging voltage Vcdc is performed. FIG. 14 is a diagram illustrating a relationship between a control voltage and a developing voltage. When there is no variation in components, a relationship between the control voltage and the developing voltage is as indicated by a solid line. When there is variation in the components, the relationship is as indicated by a broken line. Referring to FIG. 14, a correction method of the control voltage Vc of the charging voltage Vcd will be described. For example, it is assumed that a developing voltage is −320 V when the control voltage Vc is 2.0 V. To set the developing voltage to −300 V, the control voltage Vc of the charging voltage is 2.0×(−300)/(−320)=1.875 V. The control voltage Vc is corrected to execute steps S302 and S302. In step S303, when the desired voltage is obtained (YES in step S303), the processing proceeds to step S305.

In step S305, the charging voltage Vcdc' measured in step S202 and the control voltage set at that time are stored in a nonvolatile storage unit 424 in the engine control unit 104. The nonvolatile storage unit 424 is desirably mounted on a substrate for generating the charging voltage and the developing voltage.

In step S306, the engine control unit 104 calculates a contrast correction voltage ΔV (=Vcd'−Vcdc) between the charged difference voltage Vcdc' stored in the nonvolatile storage unit 424 and a charging voltage Vcdc that is a target voltage stored in the nonvolatile storage unit 424.

In step S307, the engine control unit 104 refers to the table defining the correspondence between the contrast correction voltage and the normal exposure correction amount, and the microexposure correction amount illustrated in FIG. 11. The engine control unit 104 sets a normal exposure correction amount ΔE based on the contrast correction voltage ΔV calculated in step S306.

In step S308, as in step S307, the engine control unit 104 refers to the table defining the correspondence between the contrast correction voltage and the normal exposure correction amount, and the microexposure correction amount illustrated in FIG. 11. The engine control unit 104 sets a microexposure correction amount ΔEbg based on the contrast correction voltage ΔV calculated in step S306.

Thus, the development voltage may be controlled to approach a target value, and then the control correction voltage ΔV may be obtained. Then, based on obtained ΔV, the normal exposure correction amount ΔE and the microexposure correction amount ΔEbg may be set. Then, correction of a normal exposure amount and a microexposure amount is performed based on the flowchart illustrated in FIG. 7 in the same manner as the first exemplary embodiment. When the normal exposure correction amount ΔE and the microexposure correction amount ΔEbg are set by the aforementioned method, when the flowchart illustrated in FIG. 7 is executed, needless to say, the processing is performed by setting a developing voltage Vdc" controlled to approach the target value by changing the control voltage.

Figure 13:
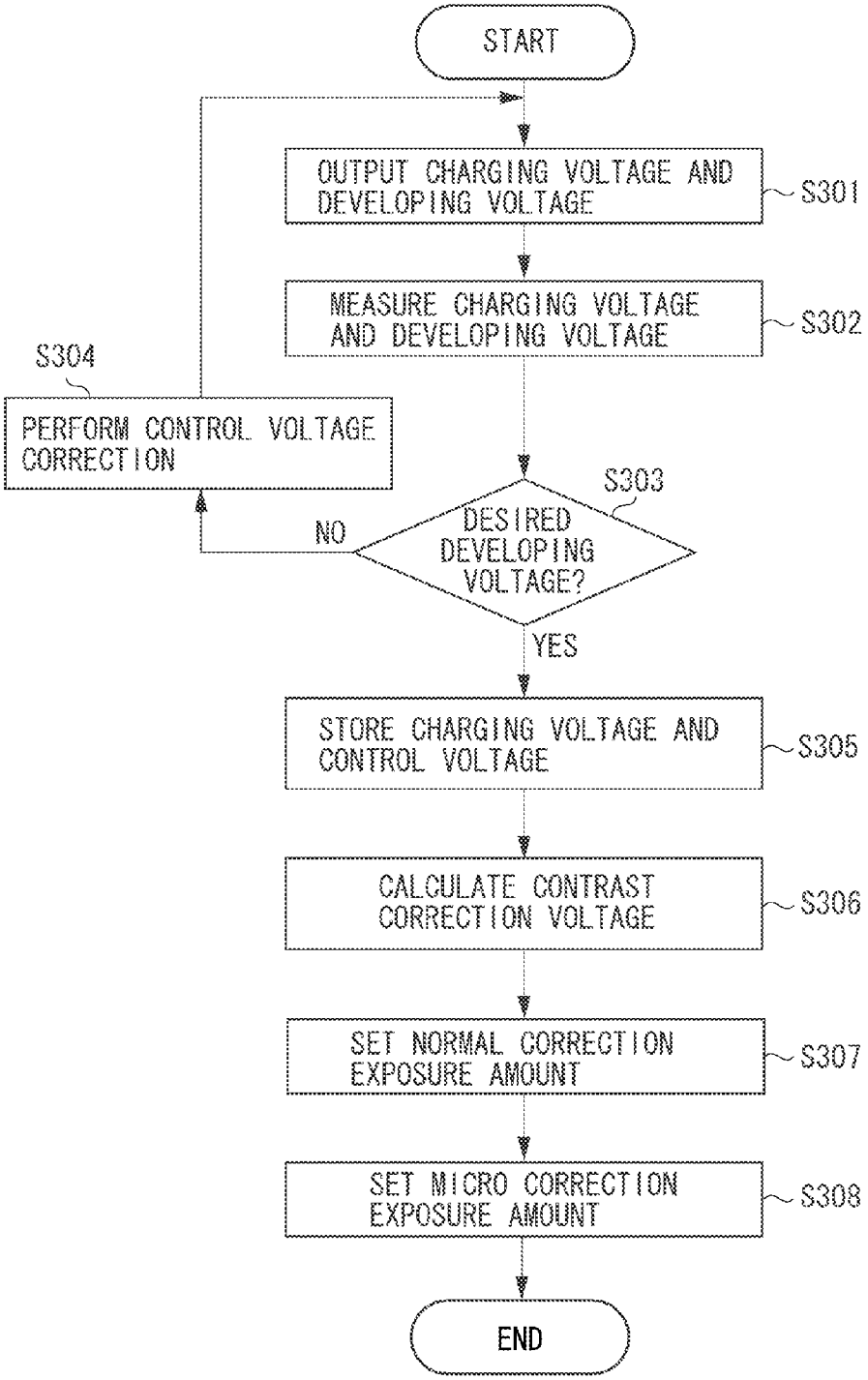
FIG. 13 is a flowchart illustrating processing for correcting variations in a charging voltage Vcdc and a developing voltage Vdc by controlling a normal exposure amount, a microexposure amount, and a control voltage Vc of a charging voltage Vcd.

In the present exemplary embodiment, in steps S303 to S305 of the flowchart illustrated in FIG. 13, the developing voltage is adjusted to be a desired voltage. However, the charging voltage may be adjusted to be a desired voltage.

<Operation/Effect>

Figure 15:
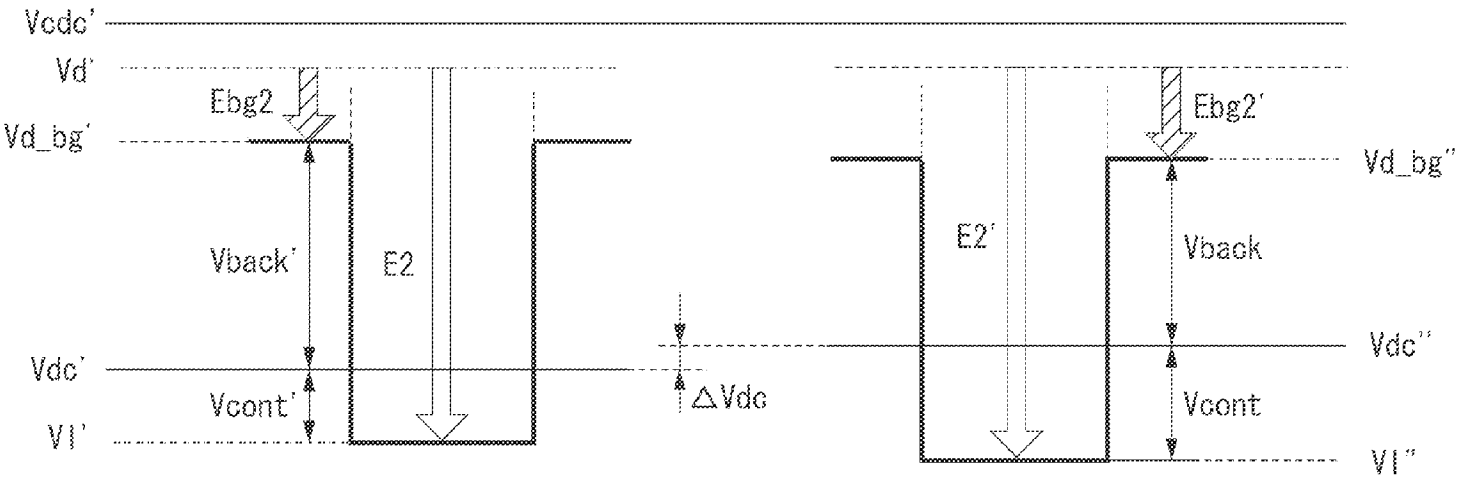
FIG. 15 is a diagram illustrating a relationship between a charging potential and a developing potential and an exposure potential based on whether correction of a normal exposure amount and a microexposure amount are performed.

FIG. 15 is a diagram illustrating a relationship among a charging potential, a developing potential, and a exposure potential based on presence or absence of correction of the normal exposure amount and the microexposure amount. As illustrated in FIG. 15, by correcting the normal exposure amount and the microexposure amount based on information about variations in the charging voltage and the developing voltage, the charging potential, the developing potential, and the exposure potential of the photosensitive drum are optimized, and the development contrast and the back contrast can be optimized. As a result, image failures can be suppressed. As in the present exemplary embodiment, by correcting the normal exposure amount and the microexposure amount after one of the developing voltage and the charging potential has been adjusted to be a desired voltage, the table illustrated in FIG. 11 can be more accurate. In other words, the table illustrated in FIG. 11 can be set as a table with importance placed on dealing with variation on one of the charging voltage and the developing voltage, and the charging voltage and the developing voltage can be optimized more accurately.

The first and second exemplary embodiments are the example of the configuration of the method for performing microemission and normal emission by subjecting the pulse signal by the microexposure signal 68*a* and the pulse signal by the pulse width signal 60*a* at the laser driver 62*a*. However, the present invention is not limited to this. Specifically, in the first and second exemplary embodiments, emission intensity of the microemission is almost equal to that of the normal emission based on the luminance signal 61*a* (depending on response characteristics, in a case of short pulse driving time, a peak value of the light pulse is reduced, and substantial emission intensity may slightly drop). The exemplary embodiments have been described on the assumption of the configuration for performing microemission of the PWM method so that by shortening the pulse driving time with emission intensity almost equal to that of the normal exposure, an exposure amount average per unit area of the photosensitive drum surface can be a microexposure amount preventing adhesion of toner. However, the exemplary embodiments can be applied to microemission in a configuration described below. An embodiment of the present invention can be applied to a two-standard emission method capable of causing a laser diode to emit light with emission intensity of two standards, namely, first emission intensity for normal exposure and second emission intensity for microexmission lower than the first emission intensity. In this case, parameters relating to the first emission intensity and the second emission intensity (e.g., first laser driving current for determining first emission intensity and second laser driving current for determining second emission intensity) only need to be changed so as to respectively change the first emission intensity and the second emission intensity based on the set normal exposure correction amount ΔE and the microexposure correction amount ΔEbg. Even with this configuration, needless to say, as in the exemplary embodiments described above, the charging potential, the developing potential, and the exposure potential of the photosensitive drum can be optimized, and the development contrast and the back contrast can be optimized. As a result, image failures can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-199517 filed Sep. 11, 2012, which is hereby incorporated by reference herein in its entirety.

What is claimed is:

1. An image forming apparatus comprising:

a photosensitive member;

a charging unit configured to charge the photosensitive member by outputting a charging voltage;

an exposure unit configured to form a latent image on the photosensitive member by irradiating the charged photosensitive member with light;

a developing unit configured to develop the latent image on the photosensitive member with toner by outputting a developing voltage; and a control unit configured to cause the exposure unit to expose an image portion of the photosensitive member to which the toner is to be adhered by a first exposure amount, and expose a non-image portion of the photosensitive member to which the toner is not to be adhered by a second exposure amount smaller than the first exposure amount, wherein the control unit corrects the preset second exposure amount based on information about a difference between the charging voltage output from the charging unit and a predetermined charging voltage and/or information about a difference between the developing voltage output from the developing unit and a predetermined developing voltage.

2. The image forming apparatus according to claim 1, wherein the information about the difference between the charging voltage output from the charging unit and the predetermined charging voltage and/or the information about the difference between the developing voltage output from the developing unit and the predetermined developing voltage are measured by a measurement unit.

3. The image forming apparatus according to claim 1, wherein the control unit includes a table for obtaining a value as to a correction amount of the second exposure amount based on the information about the difference between the charging voltage output from the charging unit and the predetermined charging voltage and/or the information about the difference between the developing voltage output from the developing unit and the predetermined developing voltage.

4. The image forming apparatus according to claim 1, wherein the preset second exposure amount is set in association with an integrated number of rotations of the photosensitive member.

5. The image forming apparatus according to claim 1, wherein the control unit corrects the preset first exposure amount based on the information about the difference between the charging voltage output from the charging unit and the predetermined charging voltage and/or the information about the difference between the developing voltage output from the developing unit and the predetermined developing voltage.

6. The image forming apparatus according to claim 1, wherein the charging voltage and the developing voltage are supplied from a common power source.

7. The image forming apparatus according to claim 6, wherein the charging voltage and the developing voltage are respectively voltages obtained by dividing or boosting a common voltage supplied from the common power source by an electric element.

8. The image forming apparatus according to claim 7, wherein the image forming apparatus includes a plurality of photosensitive members, and a plurality of charging units and developing units corresponding respectively to the photosensitive members, a plurality of charging voltages output from the plurality of charging units are respectively supplied from the common power source, and a plurality of developing voltages output from the plurality of developing units are respectively supplied from the common power source.

* * * * *